US005737716A

United States Patent [19]

Bergstrom et al.

[11] Patent Number: 5,737,716

[45] Date of Patent: Apr. 7, 1998

[54] METHOD AND APPARATUS FOR ENCODING SPEECH USING NEURAL NETWORK TECHNOLOGY FOR SPEECH CLASSIFICATION

[75] Inventors: Chad Scott Bergstrom, Chandler, Ariz.; Sidney Clarence Garrison, III, deceased, late of Tempe, Ariz., by Ruth R. Garrison, personal representative

[73] Assignee: Motorola, Schaumburg, Ill.

[21] Appl. No.: 578,730

[22] Filed: Dec. 26, 1995

[51] Int. Cl.[6] ..... G10L 5/00

[52] U.S. Cl. ..... 704/202; 704/232; 704/259; 704/208

[58] Field of Search ..... 395/2.1, 2.11, 395/2.2, 2.23, 2.24, 2.35, 2.41, 2.45, 2.68, 2.3

[56] References Cited

U.S. PATENT DOCUMENTS

| | | | |
|---|---|---|---|
| 5,345,536 | 9/1994 | Hoshimi et al. | 395/2.52 |
| 5,404,422 | 4/1995 | Sakamoto et al. | 395/2.41 |
| 5,414,796 | 5/1995 | Jacobs et al. | 395/2.3 |

*Primary Examiner*—Allen R. MacDonald
*Assistant Examiner*—Alphonso A. Collins
*Attorney, Agent, or Firm*—Sherry J. Whitney

[57] ABSTRACT

A low-rate voice coding method and apparatus uses vocoder-embedded neural network techniques. A neural network controlled speech analysis processor includes a neural network which manages speech characterization, encoding, decoding, and reconstruction methodologies. The voice coding method and apparatus uses multi-layer perceptron (MLP) based neural network structures in single or multi-stage arrangements.

41 Claims, 12 Drawing Sheets

METHOD AND APPARATUS FOR ENCODING SPEECH USING NEURAL NETWORK TECHNOLOGY FOR SPEECH CLASSIFICATION

FIELD OF THE INVENTION

The present invention relates generally to human speech compression, and more specifically to human speech compression using neural networks.

BACKGROUND OF THE INVENTION

A number of speech coding applications utilize modal estimates which enable a vocoder to execute a specific characterization and coding methodology tailored to an identified speech "mode" or "classification". These modal states include, but are not limited to, periodic modes, non-periodic modes, mixed modes, tones, silence conditions, and phonetic classes. Each of the modal states embodies specific attributes which can be efficiently exploited for characterization, data storage, transmission, and bandwidth reduction using distinct algorithmic techniques.

Prior-art speech coding applications typically utilize ad-hoc, expert-system or rule-based classification architectures to discriminate between given modes and to select the appropriate modeling methodology. These inflexible, threshold-based solutions are often difficult and time consuming to develop, are subject to error, and are not sufficiently robust in the face of noise and interference. Such problems negatively influence performance of low-rate speech coding applications, resulting in lower-quality speech and inefficient use of bandwidth.

As discussed above, in order to select an appropriate modeling method for the non-stationary speech waveform, a number of voice coding applications analyze parameterized speech information, called "features", to derive a modal estimate which represents the character of the underlying data. Such prior-art applications typically implement conventional techniques which use error-prone, rule-based algorithms for modal classification. During development of such algorithms, the relative importance of the parameterized feature vector elements is not readily apparent, and significant effort must be expended during algorithm development in order to determine the effectiveness of each new candidate input feature.

Given a significant number of feature elements and modal classes, the essential elements and relative weighting necessary to achieve a desired result can be difficult to determine using standard statistical and ad-hoc analysis techniques, especially given the presence of noise and interference. Such inflexible techniques can result in non-optimal, inaccurate solutions which may not achieve satisfactory results. Furthermore, modification of such algorithms by adding or removing input feature elements requires lengthy re-analysis in order to "tune" algorithm performance. In light of these limitations, what is needed is a method and apparatus for applying neural networks within a voice coding architecture to control characterization, encoding, and reconstruction methodologies in order to improve voice coding quality, conserve bandwidth, and accelerate the development process. Further needed is a method and apparatus for training a pre-selected, vocoder-embedded neural network architecture to perform a modal speech classification task using backpropagation methods, a database of extracted speech features, and the desired modal classification responses.

DETAILED DESCRIPTION OF THE DRAWINGS

Figure 1:
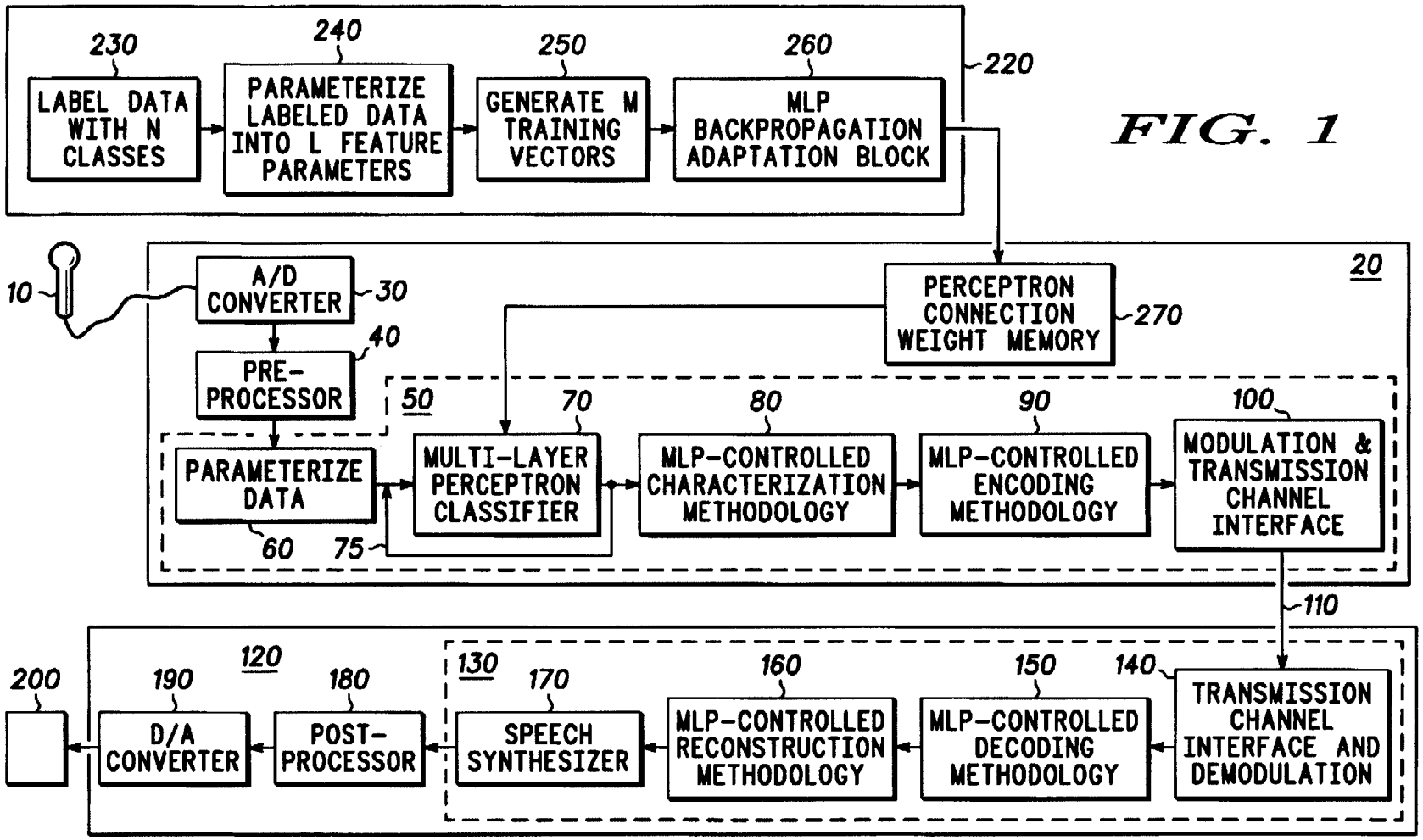
FIG. 1 illustrates a voice coding apparatus in accordance with a preferred embodiment of the present invention.

In summary, the method and apparatus of the present invention provides an apparatus and method for high-quality speech compression using advanced, vocoder-embedded neural network techniques. Improved performance over prior art methods is obtained by means of neural network management of speech characterization, encoding, decoding, and reconstruction methodologies.

The method and apparatus of the present invention provides a new and novel means and method for low-rate voice coding using advanced, vocoder-embedded neural network techniques. Improved performance over prior art methods is obtained by means of neural network management of speech characterization, encoding, decoding, and reconstruction methodologies. The method and apparatus of the present invention implements an advanced Multi-Layer Perceptron (MLP) based structure in a single or multi-stage arrangement within a low-rate voice coding architecture to provide for improved speech synthesis, improved classification, improved robustness in interference conditions, improved bandwidth utilization, and greater flexibility over prior-art techniques.

The method and apparatus of the present invention solves the problems of the prior art by applying neural network MLP techniques within a low-rate speech coding architecture. Neural network solutions provide for rapid development, improved classification accuracy, improved speech analysis and speech synthesis architectures, and improved immunity to interference when trained with appropriate characteristic features. In solving these specific problems within an efficient speech compression structure, the method and apparatus of the present invention provide for enhanced synthesized speech quality, improved bandwidth utilization, improved interference rejection, and greater flexibility over prior-art solutions.

In one embodiment of the invention, the input waveform is classified into a category which reflects either speech or nonspeech data. This type of speech/nonspeech classification is sometimes referred to as "voice activity detection", and is performed in an additional pre-classifier stage embodied within the MLP structure.

In the case of a "non-speech" classification, the usual characterization and encoding process is not performed. This modal classification is of use when the speech compression architecture is part of a multi-channel communication system. In this situation, a non-speech classification results in the re-allocation of bandwidth resources to active channels, effectively increasing system capacity and efficiency. For this scenario, the receiver corresponding to the inactive channel can output a low level of noise, sometimes referred to as "comfort noise", over the duration of the non-speech mode.

In the case of a "speech" classification, a subsequent classification can include a degree of periodicity associated with the waveform segment under consideration. Typically, sampled speech waveforms can be classified as highly-correlated (periodic) speech, un-correlated (non-periodic) speech, or more commonly, a mixture of both (mixed).

For the method and apparatus of the present invention, one embodiment calculates a modal estimate derived by the MLP to provide either a fractional value representing the degree of speech periodicity or a non-speech indication. Other modal classes are also appropriate, such as phonetic classifications. These modal estimates enable the voice coder to adapt to the input waveform by selecting a modeling method and coding method which exploits the inherent characteristics of the given mode.

For example, given a modal classification of "speech" as derived by the neural network, the speech compression apparatus can divide its effort into two modeling methodologies which capture the basis elements of the periodic, correlated portion of the speech and the non-periodic, uncorrelated portion of the speech.

In one simple embodiment of this technique, the neural network classification would consist of either purely periodic or purely non-periodic designations. In this simple bi-modal situation, based upon the neural network classification, the characterizing methodology would select one of two modeling methods which attempt to capture the basis elements of each distinct mode for each basis parameter. For the purely periodic case, specific portions of the speech or excitation waveform can be extracted for modeling in the time and/or frequency domain, assuming limited, non-periodic contribution. Alternatively, for the purely non-periodic case, the speech or excitation waveform is modeled assuming limited periodic contribution.

Data reduction is achieved by the application of signal processing steps specific to the classification mode. For example, one embodiment of the method and apparatus of the present invention represents the excitation waveform by several basis element parameters which encompass energy, mean, excitation period, and modeling error for each of the basis elements.

Signal processing steps that "characterize" each of the basis elements and basis element modeling errors can vary depending upon the modal classification. Correlation techniques, for example, may prove to be useful only in the case of significant periodic energy. Spectral or Cepstral representations may only provide a benefit for specific periodic or phonetic classes. Similarly, characterization filtering applied for the purposes of data reduction (e.g., lowpass, highpass, bandpass, pre-emphasis, de-emphasis) may only be useful for particular modes of speech, and can in fact cause perceptual degradation if applied to other modes.

In the method and apparatus of the present invention, multiple levels of signal characterization are implemented for each basis parameter which collectively represent the compressed speech waveform. Each characterization method is chosen with the specific class properties for that parameter in mind, so as to achieve the maximum data reduction while preserving the underlying properties of the speech basis elements.

Following characterization, a preferred embodiment of the method and apparatus of the present invention selects an appropriate encoding methodology for the selected mode. Each of the classes maps to an optimal or near-optimal encoding method for each characterized basis element. For example, periodic and non-periodic classifications could utilize separately-developed vector quantizer (VQ) codebooks (referred to herein as "modal component codebooks") for each of the characterized basis elements and characterized basis element modeling errors.

Furthermore, specific codebook structures and codebook methods, such as VQ, staged VQ, or wavelet VQ may be more efficient for certain modal states. For example, wavelet VQ implementations would provide little coding gain for those modal states known to have a uniform, or "white" energy distribution across a wavelet decomposition.

In an alternate embodiment, an MLP-controlled, pseudo-continuous methodology; adjusts bandwidth allocation based upon the periodic and non-periodic components which are present in the waveform under consideration.

Some prior-art methods utilize a number of algorithmic techniques to separate the composite waveform into orthogonal waveforms, each of which can be individually characterized, transmitted, and used to reconstruct the speech waveform. In the context of the method and apparatus of the present invention, the single or multi-stage MLP-derived modal classification can be used to control bandwidth allocation between the separated, orthogonal components. In this manner, an MLP-derived degree of periodicity (DP), where $0.0<DP<1.0$, controls the bandwidth allocated toward modeling and characterizing of the periodic portion and the non-periodic portion of each characterized basis element.

For example, a VQ scheme incorporated within the encoding methodology could utilize the quantized value of the MLP-derived DP to control the size of each modal components' codebooks for each of the basis parameters and basis parameter modeling errors. In this manner, the dominant parameters of the modeled waveforms (as measured by the neural network classifier) are modeled more accurately than the less-dominant secondary components. As such, the MLP-derived fractional DP value could map to a manageable number of codebook size increments for each signal component.

The embodiment discussed above would be especially beneficial using multi-stage VQ, whereby bandwidth can be adjusted for a given basis parameter by including or excluding successive stages in the multi-stage structure. In this manner, dominant parameters, as determined by the MLP classifier, can be more accurately modeled via inclusion of subsequent available stages in the multi-stage quantizer. Conversely, less dominant parameters can use fewer of the available quantizer stages. Such an embodiment would also be ideal for use within a variable-rate speech coding application, whereby the MLP classifier output controls the bandwidth required by the speech coder.

FIG. 1 illustrates voice coding apparatus 5 in accordance with a preferred embodiment of the present invention. Voice coding apparatus 5 includes offline adaptation processor 220, encoding device 20, and decoding device 120. Basically, adaptation processor 220 generates parameters for perceptron classifier 70 located within encoding device 20. Encoding device 20 encodes input speech data which originates from a human speaker or is retrieved from a memory device (not shown). Encoding device 20 sends the encoded speech to decoding device 120 over transmission medium 110. Transmission medium 110 can be, for example, a hard-wired connection, a public switched telephone network (PSTN), a radio frequency (RF) link, an optical or optical fiber link, a satellite system, or any combination thereof. Decoding device 120 decodes the encoded speech. Decoding device 120 can then output the decoded speech to audio output device 200 or can store the decoded speech in a memory device (not shown). Audio output device 200 can be, for example, a speaker.

As shown in FIG. 1, speech data is sent in one direction only (i.e., from encoding device 20 to decoding device 120). This provides "simplex" (i.e., one-way) communication. In an alternate embodiment, "duplex" (i.e., two-way) communication can be provided. For duplex communication, a second encoding device (not shown) can be co-located with decoding device 120. The second encoding device can encode speech data and send the encoded speech data to a second decoding device (not shown) co-located with encoding device 20. Thus, terminals that include both an encoding device and a decoding device can both send and receive speech data to provide duplex communication.

Referring again to FIG. 1, input speech is first processed by analog input device 10 which converts input speech into an electrical analog signal. Analog-to-digital (A/D) converter 30 then converts the analog signal to a stream of digital samples. The digital samples are operated upon by preprocessor 40, which can perform steps including high-pass filtering, adaptive filtering, removal of spectral tilt, LPC analysis, and pitch filtering. These preprocessing steps are well known to those of skill in the art.

After pre-processing, the samples are then analyzed by neural network controlled speech analysis processor 50. Processor 50 includes parameterize data block 60, MLP classifier 70, MLP-controlled characterizing methodology block 80, MLP-controlled encoding methodology block 90, and modulation and transmission channel interface block 100.

Parameterize data block 60 extracts parameters from the speech waveform representation to provide for speech analysis and discrimination capability. Example parameters whose computation is familiar to those skilled in the art include pitch, LPC gain, low-band to high-band energy ratio, correlation data, relative energy, first derivative slope change information, Cepstral features, and pitch filter gain.

Parameterize data block 60 passes a vector of the computed features to MLP classifier 70 which discriminates between a number, N, of data modes. MLP classifier 70 produces a classification corresponding to one or more of the N data modes. In order to classify the input feature vector, MLP classifier 70 functionality is defined by accessing the weights and normalization factors stored in perceptron connection weight memory 270.

The perceptron processing elements of this network use the standard weighted sum of inputs, plus a bias weight, followed by an activation function, or sigmoid f(s), which can be computed by: $1/(1+e^{-s})$. In order to ensure that the weighted summations fall within the sigmoid transition region, data normalization can first be employed on the parameterized data set by subtracting the mean $\mu_i$ and dividing by $\sigma_i$, where i ranges from 1 to L, computed over the number of vectors, M. The resulting training parameters will have zero mean and unit variance.

A preferred embodiment of the present invention incorporates two layers of perceptron processing elements in a single or multi-stage arrangement, each stage including an input layer and an output layer, although more or fewer layers can also be used. As discussed above, the method and apparatus of the present invention replaces the common, role-based mode estimation technique with one or more MLP classifiers. The multi-layer, feed-forward neural network (or networks), which follow parameterize data block 60 of FIG. 1, are first loaded with the L connection weights which were derived beforehand by offline adaptation processor 220. These now-static connection weights are incorporated into the actual decision-making algorithm by means of simple dot-product and soft-limiter mathematics.

In a preferred embodiment, MLP classifier 70 incorporates MLP decision state feedback loop 75. In alternate embodiments, state feedback loop 75 is not used. State feedback loop 75 provides a previous mode classification decision to MLP classifier 70, wherein the previous decision is input along with the other feature elements to the neural network classifier. In this manner, previous classification(s) are used to bias the neural network modal decision for the current portion of data. Since this causal relationship is generally examined under human classification of speech, the artificial neural network can mirror human classification behavior and benefit from statistical history by using the previous modal classification data to achieve more accurate results. The use of state feedback loop 75 is described further in conjunction with FIGS. 5–7.

In addition to conventional features and state feedback, MLP classifier 70 performance can benefit from the statistical relationship of contextual information, where previous, current, and future features are included as part of the input feature vector. The output of MLP classifier 70 will be the maximum-likelihood class selected from class set N, where N represents a number of distinct speech modes. The characteristics of each of the modal classes can be exploited in the apparatus of FIG. 1 in order to achieve high-quality speech compression and synthesis at low bit-rates.

Referring back to FIG. 1, MLP-controlled characterizing methodology block 80 uses the input class to select efficient characterization techniques for each identified speech mode. Block 80 can include or omit specific signal modeling and signal processing steps based upon the modal state received from MLP classifier 70. These steps can include, for example, correlation alignment, wavelet decomposition techniques, Fourier analysis, and interpolation.

A priori knowledge of the characteristics of each modal state are used by MLP-controlled characterizing methodology block 80 efficiently to extract and characterize the fundamental basis elements of the speech data for the purposes of data compression. For example, input speech with either "periodic" or "random" designations can be characterized and modeled in different ways which exploit the slowly-varying periodic characteristics and/or the rapidly-varying random characteristics of a speech segment under analysis.

MLP-controlled encoding methodology block 90 encodes the fundamental basis elements which have been extracted and characterized in MLP-controlled characterizing methodology block 80. The modal class is used to direct the encoding technique toward the method and codebook that will best represent the identified class in the current segment of speech under analysis. For example, multiple codebooks that represent a single basis element could have been previously constructed in such a manner to preserve the statistical characteristics of the identified mode. In one embodiment, the codebooks for each basis element could be subdivided into "more periodic" or "more random" codebooks to achieve greater coding efficiency. Coding methods that best represent the identified class can be implemented such as scalar, VQ, multi-stage VQ, and wavelet VQ, among others. Another embodiment could implement variable-rate schemes whereby the identified class is used to direct more bandwidth to the dominant modal state. Still other embodiments could more efficiently encode parameters based upon phonetic classifications of the input data under analysis. MLP-controlled encoding methodology block 90 results in an encoded data bitstream which represents the speech waveform.

After MLP-controlled encoding methodology block 90 encodes the data, thus producing a bitstream, modulation and transmission channel interface block 100 modulates the encoded bitstream and transmits it over transmission channel 110 to receiver 120. Receiver 120 receives the modulated, transmitted bitstream and transmission channel interface and demodulation block 140 demodulates the data using techniques well known to those of skill in the art.

Transmission channel interface and demodulation block 140 is the first stage of neural network controlled speech synthesis processor 130. Processor 130 includes transmission channel interface and demodulation block 140, MLP-controlled decoding methodology block 150, MLP-controlled reconstruction methodology block 160, and speech synthesizer 170. Basically, processor 130 synthesizes the speech from the encoded, modulated bitstream using companion inverse processes from the processes used to encode and modulate the speech waveform.

Referring back to FIG. 1, after transmission channel interface and demodulation block 140 demodulates the bitstream, MLP-controlled decoding methodology block 150 decodes the encoded vectors using companion codebooks to those used by MLP-controlled encoding methodology block 90. As with MLP-controlled encoding methodology block 90, MLP-controlled decoding methodology block 150 uses the class or classes determined from MLP classifier 70 to select the appropriate codebooks.

The output of MLP-controlled decoding methodology block 150 include the basis elements for the identified mode which are used by MLP-controlled reconstruction methodology block 160 to reconstruct the modeled waveform(s). For example, in an LPC-based approach, neural network controlled speech analysis processor 50 might model speech using the LPC coefficients and excitation waveform derived by MLP-controlled characterizing methodology block 80. The excitation waveform could be represented by several parameters which encompass energy, mean, excitation period, and parameters that measure modeling error for each of the modeled basis elements, for example. These elements would be recombined in MLP-controlled reconstruction methodology block 160 in an appropriate manner depending upon the neural-network derived class which was calculated by transmitter 20. In this manner, the modal class controls the method used to reconstruct the speech basis elements.

After reconstruction of the speech basis elements, speech synthesizer 170 uses the basis elements to reconstruct high-quality speech. For example, speech synthesizer 170 can include direct form or lattice synthesis filters which implement the reconstructed excitation waveform and LPC reflection coefficients or prediction coefficients.

Post processor 180 then processes the reconstructed waveform. Post processor 180 consists of signal post processing methods well known to those of skill in the art. These methods include, for example, adaptive post filtering techniques and spectral tilt re-introduction.

Reconstructed, post-processed digitally-sampled speech from post processor 180 is then converted to an analog signal by digital-to-analog (D/A) converter 190. The analog signal can then be output to audio output device 200. Alternatively the digital or analog reconstructed speech waveforms can be stored to an appropriate storage device (not shown).

Offline adaptation processor 220 of FIG. 1 is used to train and develop perceptron connection weights for the given vocoder architecture. A speech data set is first labeled with the appropriate N modes, or classes in label data with N classes block 230. Parameterize labeled data into L feature parameters block 240 then parameterizes labeled data on a frame or subframe basis, resulting in L feature parameters. Generate M training vectors block 250 then creates M training vectors by assigning each feature vector to the appropriate class and storing the training vectors to memory (not shown). These vectors are used in a supervised teaming mode to train the MLP network using a backward error propagation ("backpropagation") adaptation process in MLP backpropagation adaptation block 260, which is familiar to those skilled in the art.

Block 260 uses a common, steepest descent algorithm to adjust the weights during adaptation or network training. Using this algorithm, the weights are adjusted after the presentation of each individual feature vector, eventually resulting in the definition of a near-optimal multidimensional "hyper-surface" which best separates the medal classes. Irrelevant or uncorrelated input vector features will have low-connection strength to the output neurons and will consequently have little effect on the final classification.

Neural networks are especially adept at determining relative importance among a large set of input feature components, whereby components that provide for class separability are given greater weight than those that do not. This inherent "feature ranking" characteristic of neural networks essentially eliminates the need for further statistical feature analysis and parameter ranking methods which are typically required for classical recognizer designs.

Once trained by offline adaptation processor 220, the W near-optimal connection weights and normalization data are stored in perceptron connection weight memory 270 of transmitter 20. The weights and normalization data are later accessed during real-time speech analysis by MLP classifier 70.

Figure 2:
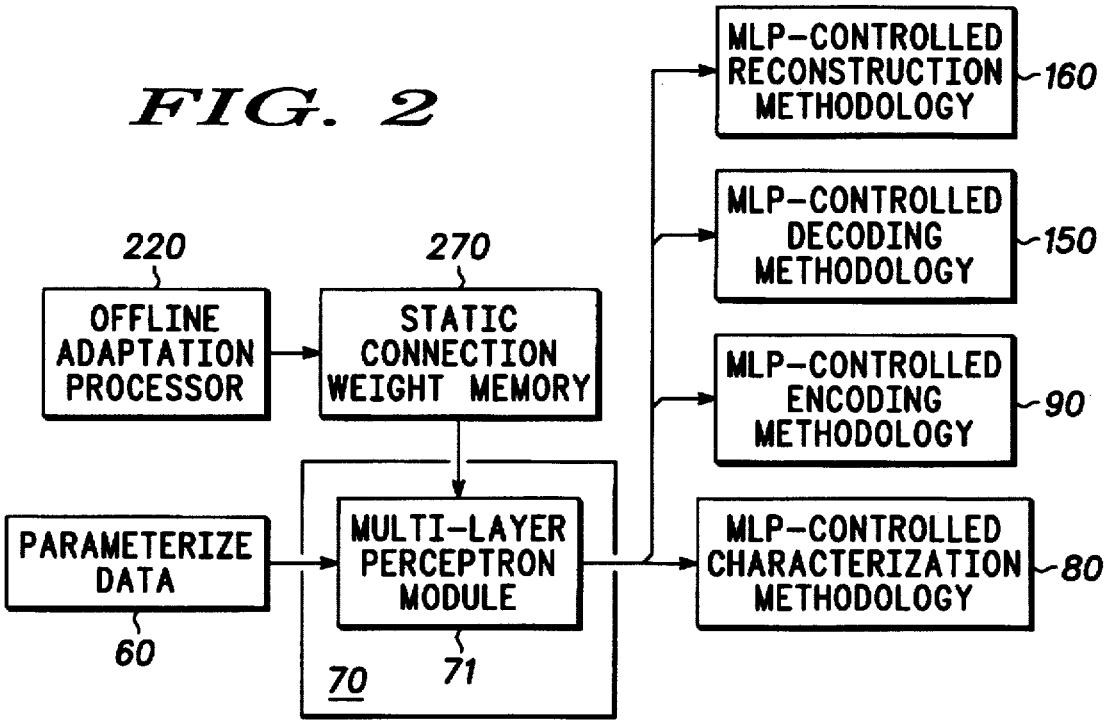
FIG. 2 illustrates a multi-layer perceptron (MLP) classifier apparatus in accordance with a first embodiment of the present invention.

FIG. 2 illustrates MLP classifier apparatus 70 in accordance with a first embodiment of the present invention. This embodiment of the MLP classifier 70 of FIG. 1 includes MLP module 71 which accepts the L dimension feature vector as calculated by parameterize data block 60 (FIG. 1). MLP module 71 also obtains the defining connection weights and normalization factors from static connection weight memory 270 (FIG. 1), which contains weights and normalization factors obtained from offline backpropagation processor 220 (FIG. 1).

In a preferred embodiment, the perceptron processing elements of the neural network use the standard weighted sum of inputs, plus a bias weight, followed by an activation function, or sigmoid f(s), which can be computed by: $1/(1+e^{-s})$. In order to ensure that the weighted summations fall within the sigmoid transition region, data normalization can first be employed on the parameterized data set by subtracting the mean $\mu_i$ and dividing by $\sigma_i$, where i ranges from 1 to L, as computed over the number of original training vectors M. The resulting computed parameters will have zero mean and unit variance, assuming that the training data closely approximates the real-time feature statistics.

A preferred embodiment of MLP module 71 incorporates a two-layer, ten perceptron architecture with eight inputs and two outputs corresponding to the current speech analysis segment, although other embodiments having more or fewer layers, perceptrons, inputs, or outputs can also be used.

Inputs to MLP module 71 in a preferred embodiment include: (1) left subframe correlation coefficient over expected pitch range, (2) left subframe LPC gain, (3) left subframe low-band to high-band energy ratio, (4) left subframe energy ratio of current segment against maximum energy of H prior segments with the appropriate class, (5) fight subframe correlation coefficient over expected pitch range, (6) fight subframe LPC gain, (7) right subframe low-band to high-band energy ratio, (8) right subframe energy ratio of current segment against maximum energy of H prior segments with the appropriate class. These features are intended as examples of features which can be used. In alternate embodiments, more, fewer, or different features can be used.

The embodiment illustrated in FIG. 2 incorporates a two neuron output which correspond to "periodic" and "non-periodic" modal classes. In alternate embodiments, more, fewer, or different output classes can also be used. For example, outputs can indicate multiple "degree-of-periodicity" or phonetic classification modes.

In addition to the use of feature context using the implementation of two-frame subframe features, improved classification performance using the preferred features across speech and nonspeech segments is obtained by adding small levels of Gaussian noise to the analysis segment prior to feature calculation. This feature calculation step serves to bias the classifier against false classification in "near-silence" conditions.

Figure 3:
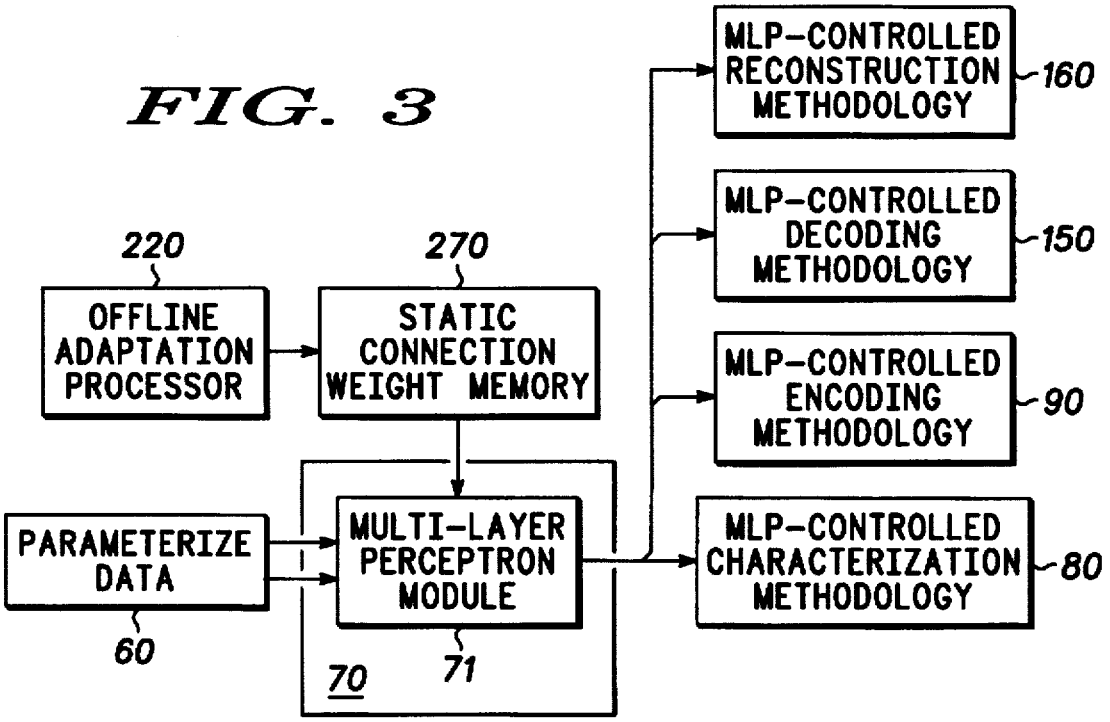
FIG. 3 illustrates an MLP classifier apparatus with interference estimate in accordance with a second embodiment of the present invention.

FIG. 3 illustrates MLP classifier apparatus with interference estimate in accordance with a second embodiment of the present invention. In this embodiment, improved classifier performance is achieved over the first MLP classifier embodiment of FIG. 1 by including an interference estimate in the input feature vectors. By training the network over a range of interference levels and by including an interference estimate as an input feature, the neural network can achieve higher correct classification rates in the face of interference.

This embodiment of the MLP classifier 70 of FIG. 1 includes MLP module 71 which accepts the L dimension feature vector and an interference estimate, both having been calculated by parameterize data block 60 (FIG. 1). Using these inputs, MLP module 71 functions much the same as MLP module 71 described in conjunction with FIG. 2.

The embodiment of MLP module 71 illustrated in FIG. 3 incorporates a two-layer, eleven perceptron architecture with nine inputs and two outputs corresponding to the current speech analysis segment, although other embodiments can also be appropriate. The inputs of this embodiment of the invention include those listed for MLP module 71 of FIG. 2, plus an interference estimate. These features are intended as examples of features which can be used. In alternate embodiments, more, fewer, or different features can be used. A preferred embodiment of MLP module 71 as shown in FIG. 2 incorporates a two-neuron output similar to that described in conjunction with FIG. 2.

Figure 4:
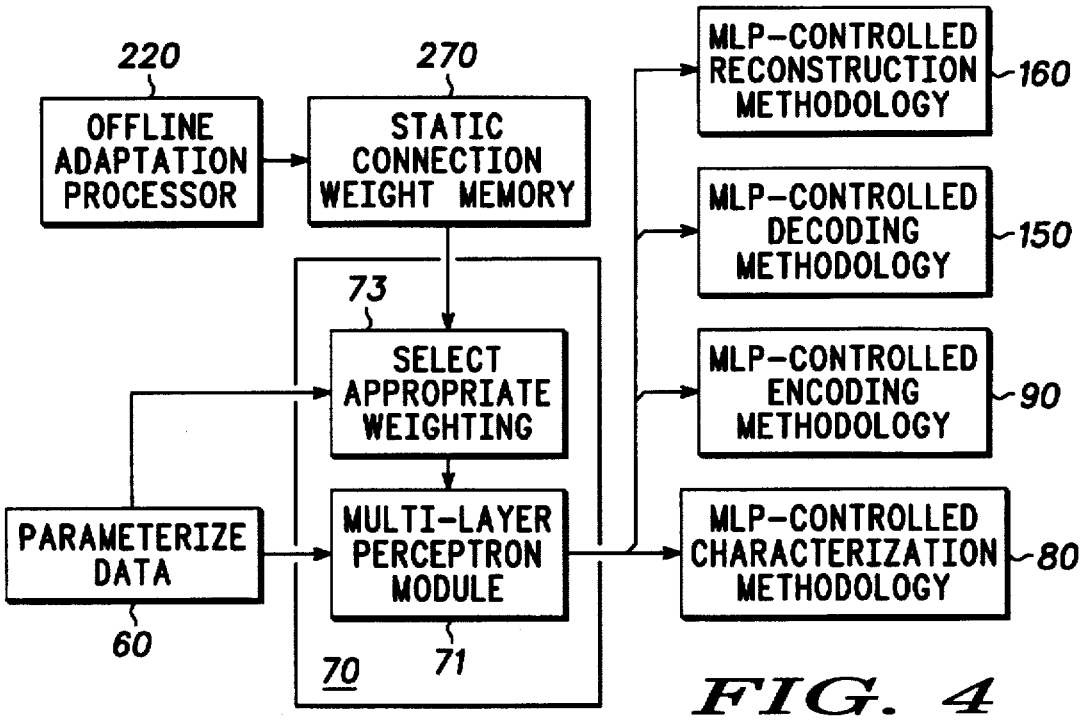
FIG. 4 illustrates an MLP classifier apparatus with interference estimate and Q quantum connection weight memory levels in accordance with a third embodiment of the present invention.

FIG. 4 illustrates MLP classifier apparatus with interference estimate and Q quantum connection weight memory levels in accordance with a third embodiment of the present invention. In this embodiment, improved classifier performance is achieved by including an interference estimate as input to MLP Classifier 70 which maps to one of the Q quantum connection weight levels. By training the network over a range of interference levels and by including an interference estimate as an input to the weighting determination, the neural network can achieve higher correct classification rates in the face of interference.

In this embodiment of the invention, the interference estimate from parameterize data block 71 is input to select appropriate weighting block 73 of MLP classifier 70. Select appropriate weighting block 73 quantizes the input interference estimate and selects the connection weight memory level from static connection weight memory 270 which corresponds to the input interference estimate. Each of the Q quantum interference levels corresponds to a family of connection weights and normalization factors specifically computed with training data corrupted with the same level of interference. In this manner, the classifier is able to adapt to changing interference conditions.

This embodiment of the MLP classifier 70 of FIG. 1 includes MLP module 71 which accepts the L dimension feature vector as calculated by parameterize data block 60 (FIG. 1). MLP module 71 reads in the defining connection weights and normalization factors determined by select appropriate weighting block 73 and otherwise functions much the same as MLP module 71 discussed in conjunction with FIG. 2.

This embodiment of MLP module 71 incorporates a two-layer, ten perceptron architecture with eight inputs and two outputs corresponding to the current speech analysis segment, although other embodiments can also be appropriate. The inputs of this embodiment of the invention correspond to those inputs listed in conjunction with the first embodiment of MLP module 71 illustrated in FIG. 2. The output of MLP module 71 also corresponds to the outputs discussed in conjunction with FIG. 2.

Figure 5:
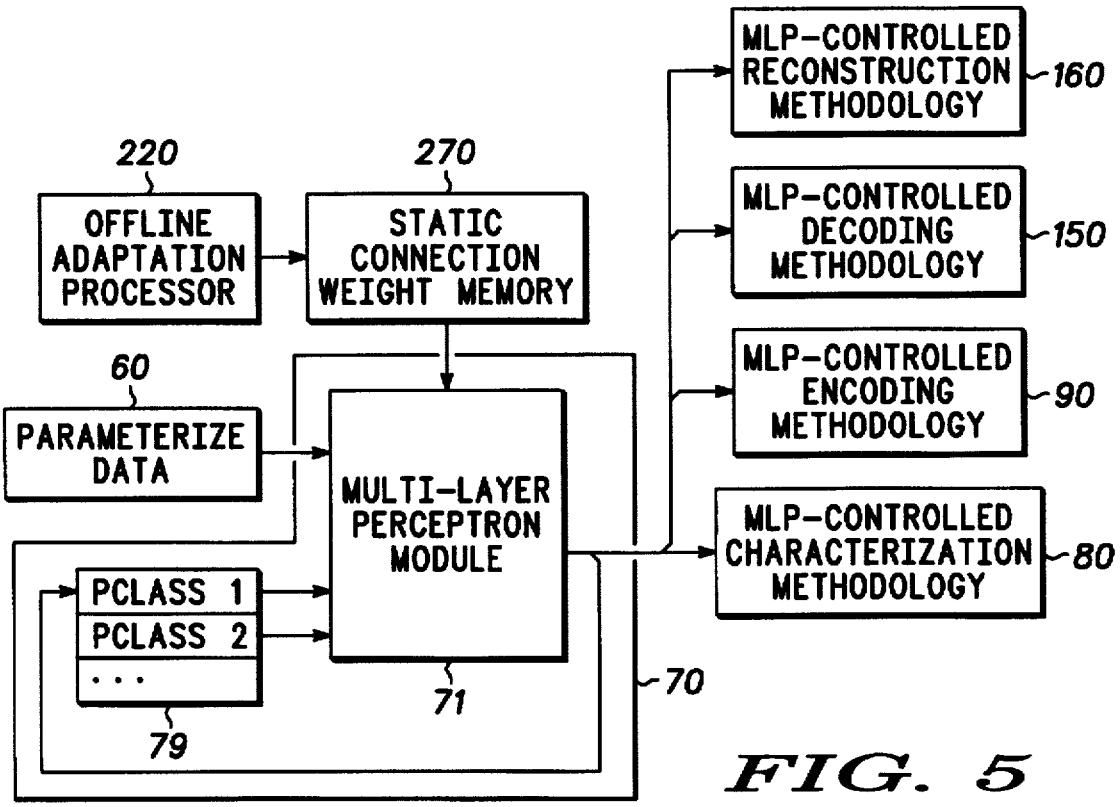
FIG. 5 illustrates an MLP classifier apparatus with output state feedback and state feedback memory in accordance with a fourth embodiment of the present invention.

FIG. 5 illustrates MLP classifier apparatus with output state feedback and state feedback memory in accordance with a fourth embodiment of the present invention. This embodiment of the MLP classifier 70 of FIG. 1 includes MLP module 71 which accepts the L dimension feature vector as calculated by parameterize data block 60 (FIG. 1). MLP module 71 reads in the defining connection weights and normalization factors from static connection weight memory 270, and otherwise functions similarly to MLP module 71 illustrated in FIG. 2.

This embodiment of MLP module 71 incorporates a two-layer, multi-perceptron architecture with eight feature inputs, P prior classification inputs from state feedback memory 79, and two outputs corresponding to the current speech analysis segment. In alternate embodiments, more or fewer layers, perceptrons, feature inputs, prior classification inputs, and outputs can be used.

State feedback memory 79 obtains the prior-mode classification decision via a feedback loop. State feedback memory 79 then inputs the prior-mode classification decision to neural network classifier 71 along with the other feature elements. In this manner, past classifications are used to bias the neural network modal decision for the current portion of data. Since this causal relationship is generally examined under human classification of speech, the artificial neural network can mirror human behavior and benefit from statistical history by using the prior modal classification data to achieve more accurate results.

The inputs of this embodiment correspond to those listed in conjunction with the first embodiment of MLP module 71 illustrated in FIG. 2, except that the prior-mode classification decision history is also an input. This embodiment of MLP module 71 incorporates a two-layer, multi-perceptron architecture with eight feature inputs plus P decision history inputs and two outputs corresponding to the current speech analysis segment, although other embodiments can also be appropriate. The eight feature inputs of this embodiment of the invention correspond to those inputs listed in conjunction with the first embodiment of MLP module 71 illustrated in FIG. 2. The output of MLP module 71 also corresponds to the outputs discussed in conjunction with FIG. 2.

Figure 6:
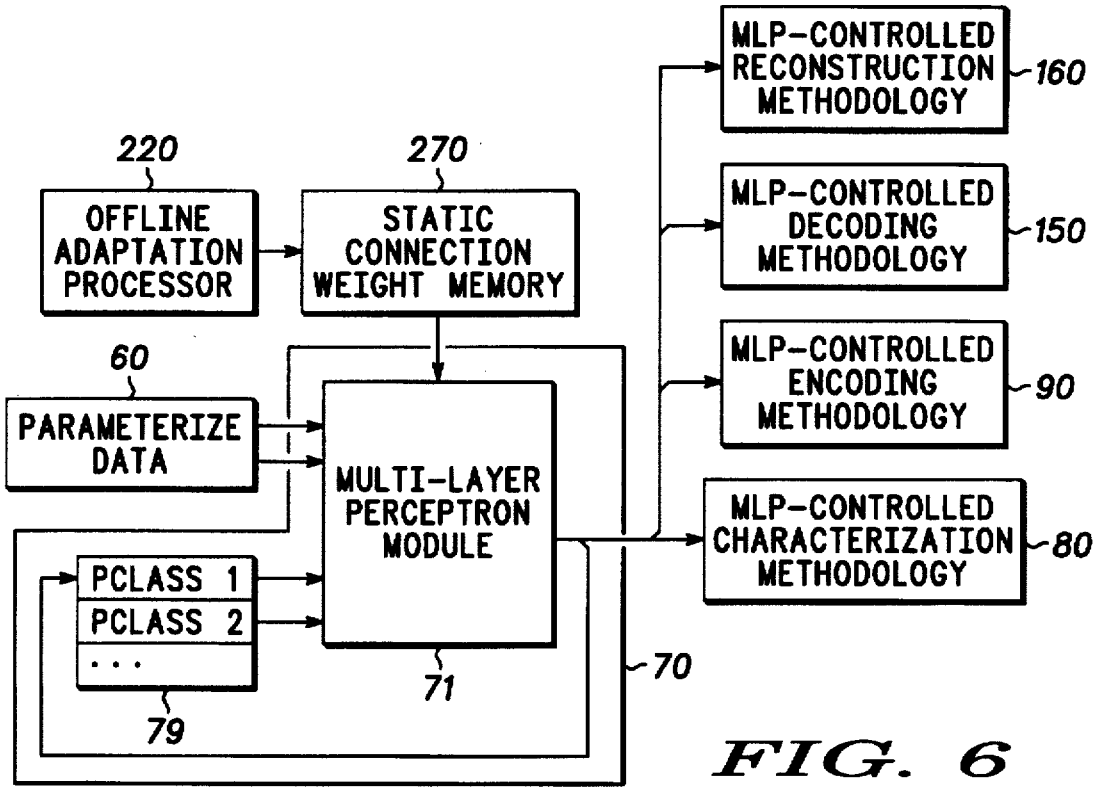
FIG. 6 illustrates an MLP classifier apparatus with output state feedback, state feedback memory, and interference estimate in accordance with a fifth embodiment of the present invention.

FIG. 6 illustrates MLP classifier apparatus with output state feedback, state feedback memory, and interference estimate in accordance with a fifth embodiment of the present invention. In this embodiment, improved classifier performance is achieved by including an interference estimate in the input feature vectors which provides the advantages discussed in conjunction with FIG. 3.

This embodiment of MLP classifier 70 of FIG. 1 includes MLP module 71 which accepts the L dimension feature vector and interference estimate as calculated by parameterize data block 60 (FIG. 1), along with the prior class history vector from state feedback memory 79. MLP module 71 functions similar to MLP module 71 described in conjunction with FIG. 5, except that the interference estimate is included as an additional feature vector.

Figure 7:
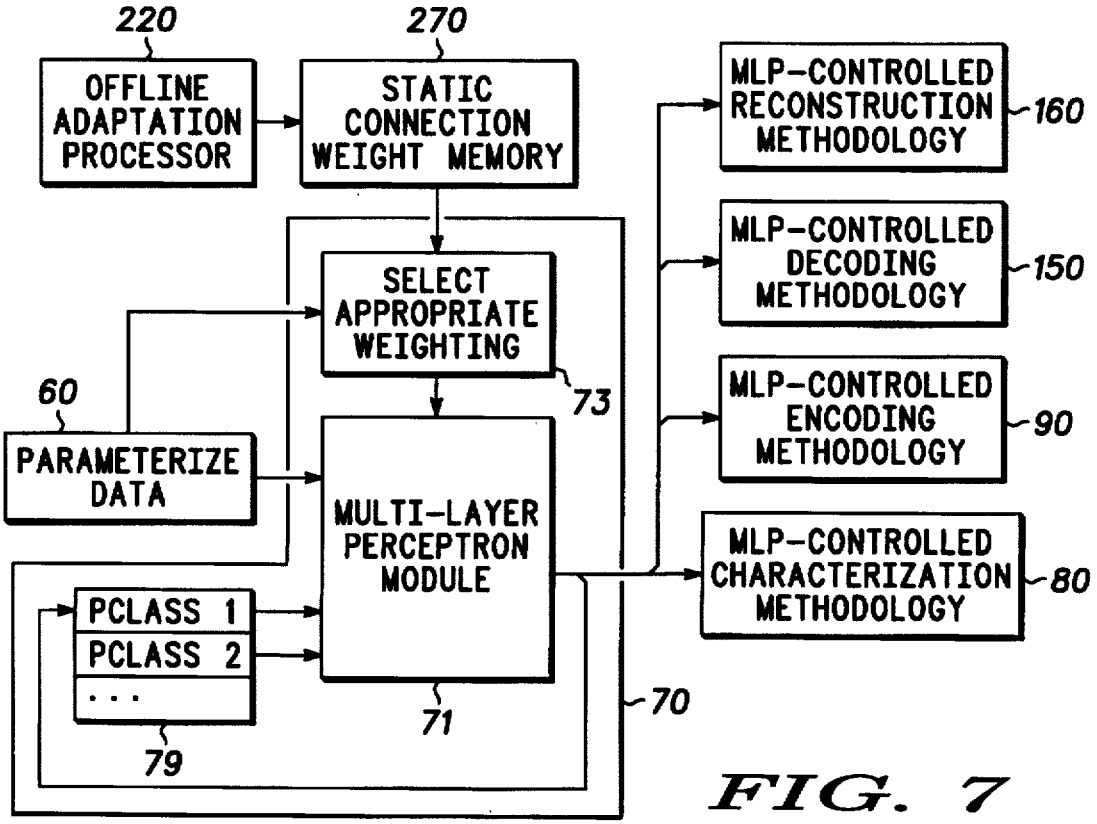
FIG. 7 illustrates an MLP classifier apparatus with output state feedback, state feedback memory, interference estimate, and Q quantum connection weight memory levels in accordance with a sixth embodiment of the present invention.

FIG. 7 illustrates MLP classifier apparatus with output state feedback, state feedback memory, interference estimate, and Q quantum connection weight memory levels in accordance with a sixth embodiment of the present invention.

In this embodiment, improved classifier performance is achieved by including an interference estimate as input to MLP classifier 70 which maps to one of the Q quantum connection weight levels. The interference estimate from parameterize data block 60 is input to select appropriate weighting block 73 of MLP classifier 70. Select appropriate weighting block 73 is discussed in detail in conjunction with FIG. 4.

This embodiment of MLP classifier 70 of FIG. 1 includes MLP module 71 which accepts the L dimension feature vector as calculated by parameterize data block 60 (FIG. 1), along with the prior class history vector. MLP module 71 reads in the defining connection weights and normalization factors from select appropriate weighting block 73, and otherwise functions similarly to MLP module 71 described in conjunction with FIG. 5.

This embodiment of MLP module 71 incorporates a two-layer, multi-perceptron architecture with eight feature inputs, P prior classification inputs from state feedback memory 79, and two outputs corresponding to the current speech analysis segment. In alternate embodiments, more or fewer layers, perceptrons, feature inputs, prior classification inputs, and outputs can be used.

Figure 8:
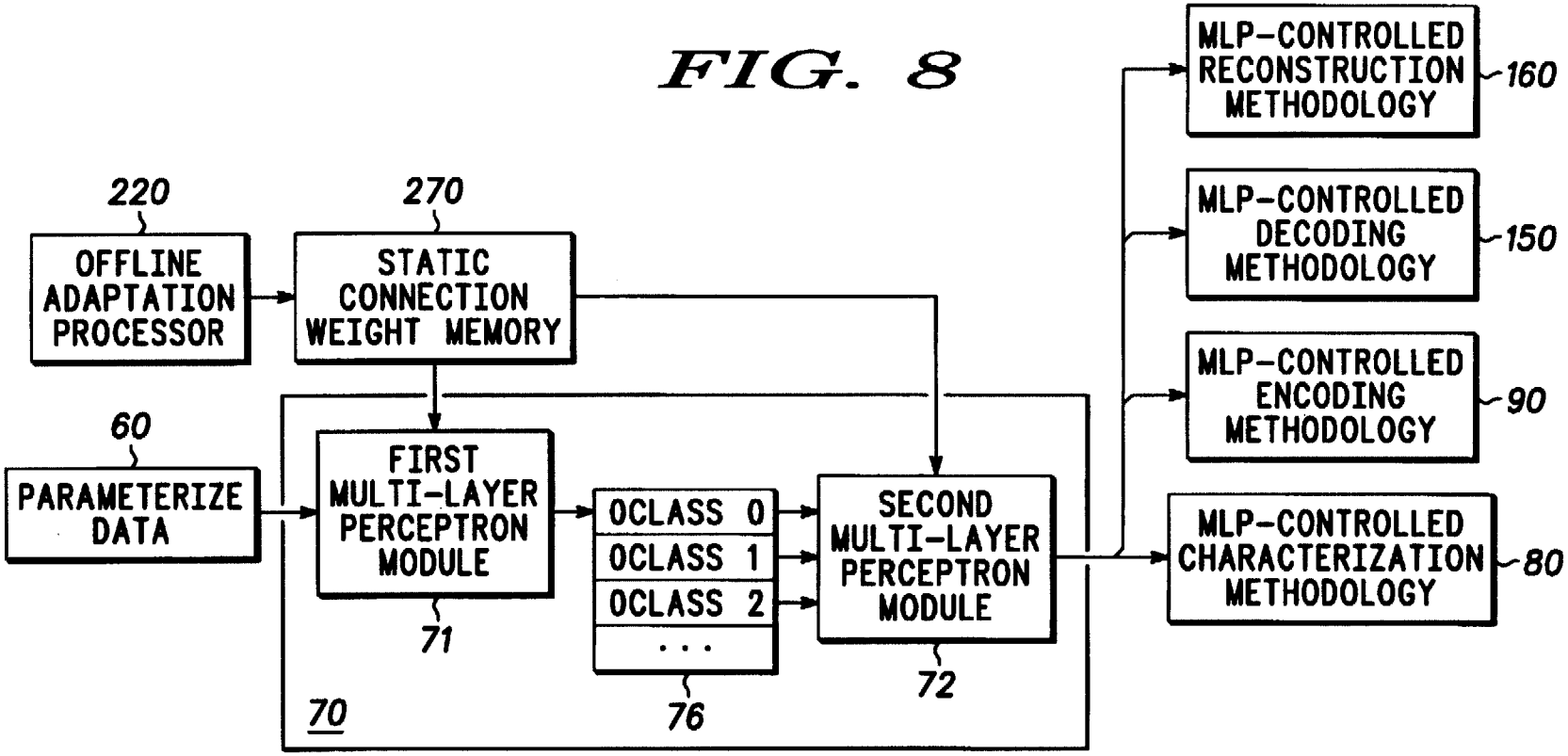
FIG. 8 illustrates an MLP classifier apparatus with multiple MLP modules in a staged configuration and preliminary output class memory in accordance with a seventh embodiment of the present invention.

FIG. 8 illustrates MLP classifier apparatus with multiple MLP modules in a staged configuration and preliminary output class memory in accordance with a seventh embodiment of the present invention. In this embodiment, two distinct neural networks, first MLP module 71 and second MLP module 72, are used in series to produce a more accurate classification. This structure requires two training sessions, one for each MLP. Separately-trained, second MLP module 72 accepts one or more prior output decisions of first MLP module 71 to refine the modal classification. The O previous output decisions are stored in output class memory 76 and are input as a vector into second MLP module 72.

First MLP module 71 which accepts the L dimension feature vector as calculated by parameterize data block 60 (FIG. 1). First MLP module 71 and second MLP module 72 read in the defining connection weights and normalization factors W1 and W2 from static connection weight memory 270.

A preferred embodiment of first MLP module 71 incorporates a two-layer, ten perceptron architecture with eight inputs and two outputs corresponding to the current speech analysis segment. A preferred embodiment of second MLP module 72 includes one or more perception layers with final output corresponding to the maximum likelihood class, given the preliminary output class history vector from first MLP module 71.

A preferred embodiment of first MLP Module 71 incorporates a two neuron output which corresponds to a preliminary output class of either a "periodic" or "non-periodic" designation. The preliminary output class from first MLP Module 71 is stored in output class memory 76, which contains up to O prior states. As described previously, alternate embodiments may use more, fewer, or different output classes.

Figure 9:
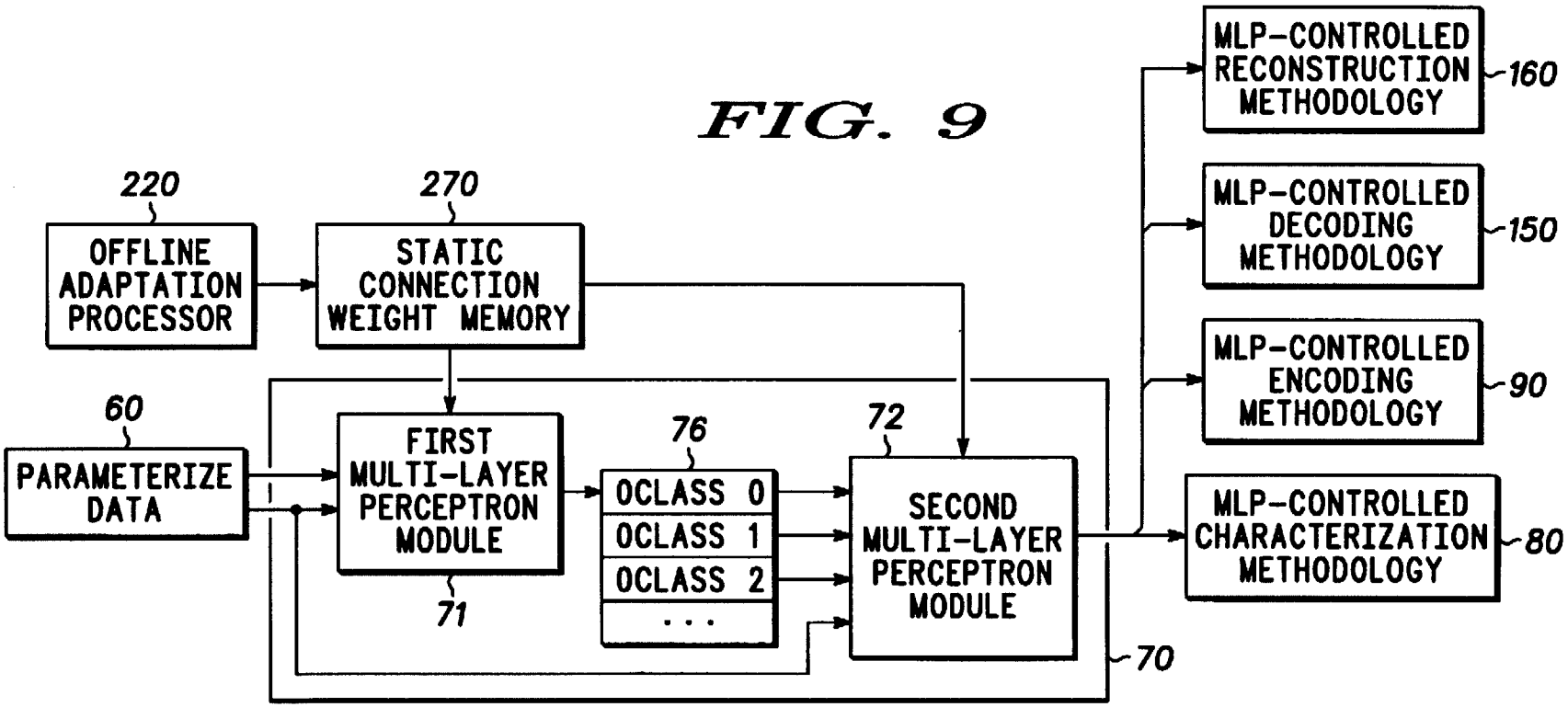
FIG. 9 illustrates an MLP classifier apparatus with multiple MLP modules in a staged configuration, preliminary output class memory, and interference estimate in accordance with an eighth embodiment of the present invention.

FIG. 9 illustrates MLP classifier apparatus with multiple MLP modules in a staged configuration, preliminary output class memory, and interference estimate in accordance with an eighth embodiment of the present invention. This embodiment functions much the same as the embodiment described in conjunction with FIG. 8, except that in this embodiment, improved classifier performance is achieved by including an interference estimate in the input feature vectors. The use and benefits obtained by inputting an interference estimate are described in detail in conjunction with FIG. 3.

Figure 10:
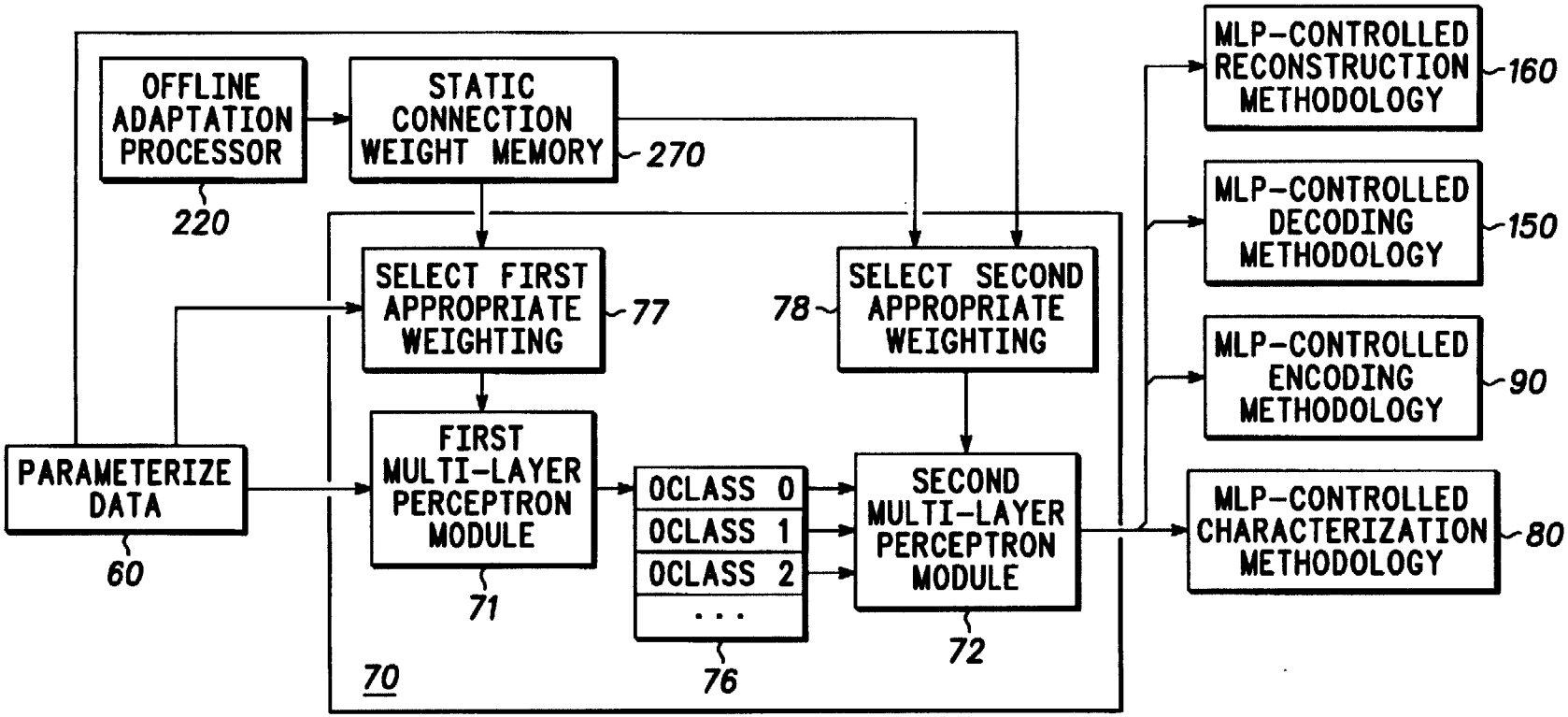
FIG. 10 illustrates an MLP classifier apparatus with multiple MLP modules in a staged configuration, preliminary output class memory, interference estimate, and Q quantum connection weight memory levels in accordance with a ninth and preferred embodiment of the present invention.

FIG. 10 illustrates MLP classifier apparatus with multiple MLP modules in a staged configuration, preliminary output class memory, interference estimate, and Q quantum connection weight memory levels in accordance with a ninth and preferred embodiment of the present invention. This embodiment functions much the same as the embodiment described in conjunction with FIG. 8, except that in this embodiment, improved classifier performance is achieved by including an interference estimate as input to MLP classifier 70 which maps to one of the Q quantum connection weight levels.

In this embodiment, the interference estimate is input to select appropriate weighting blocks 77, 78 of MLP classifier 70. Select appropriate weighting blocks 77, 78 quantize the input interference estimate and select the connection weight memory level from static connection weight memory 270 which corresponds to the input interference estimate. The functionality of select appropriate weighting blocks 77, 78 is described in detail in conjunction with FIG. 4.

First MLP module 71 and second MLP module 72 read in the defining connection weights and normalization factors W1 and W2 from select appropriate weighting blocks 77, 78, respectively.

Figure 11:
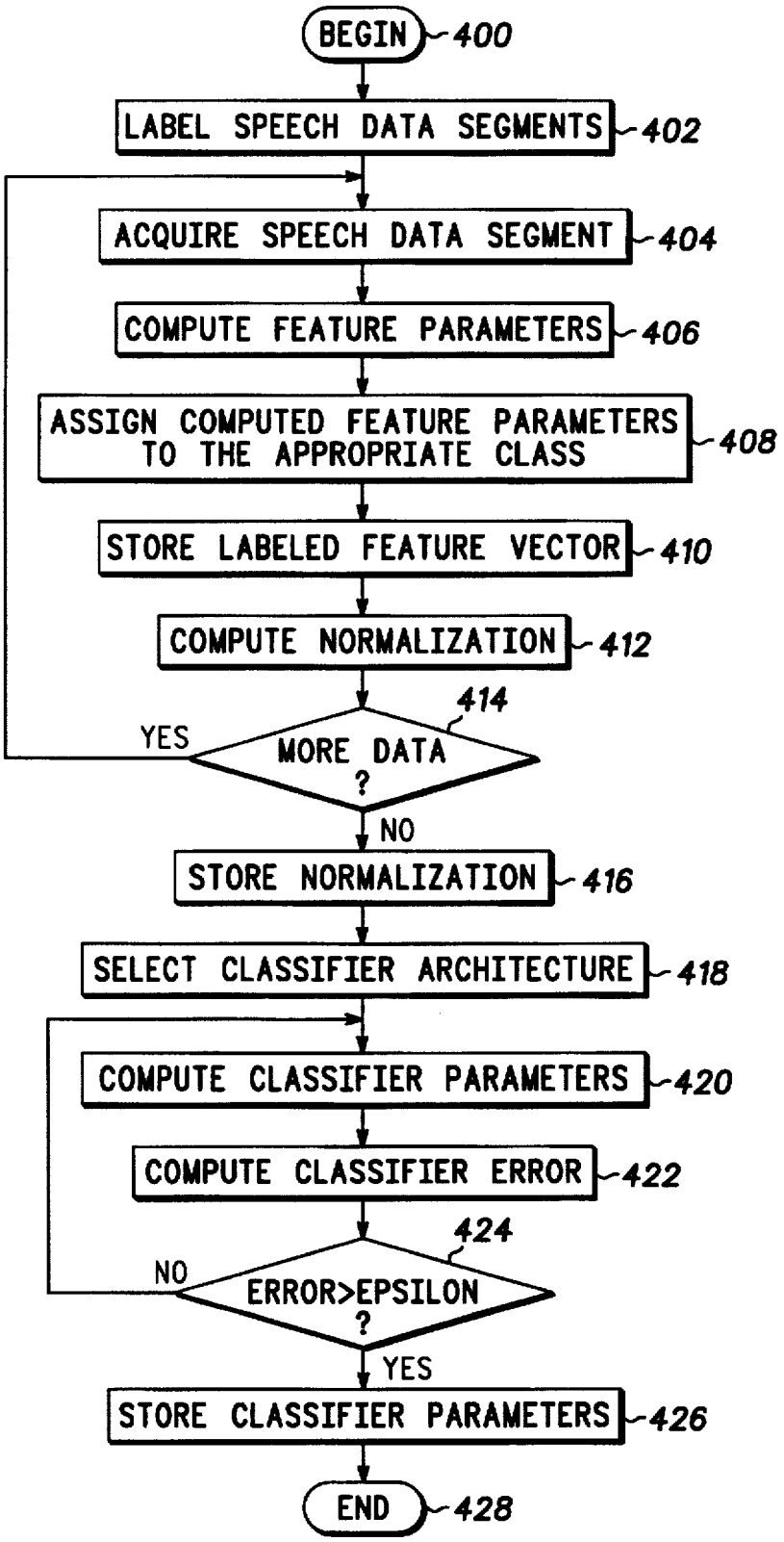
FIG. 11 illustrates an offline MLP adaptation process in accordance with a preferred embodiment of the present invention.

FIG. 11 illustrates an offline MLP adaptation process in accordance with a preferred embodiment of the present invention. The offline MLP adaptation process corresponds to steps performed by offline adaptation processor 220 (FIG. 1).

The offline adaptation process begins 400 by performing the step 402 of labeling speech data segments with N identified classes. For example, speech segments can be labeled as "periodic" or "non-periodic" classes in a two-class compression method. In alternate embodiments, more or different classes can be used, such as "degree-of-periodicity" classes or phonetic classes. Labeled data is typically stored in a memory device.

Steps 404–406 correspond to functions performed by parameterize labeled data into L feature parameters block 240. In step 404, a segment of digital speech data is acquired and loaded according to an apriori "frame" structure. For example, a typical frame structure can be on the order of 30 ms, which at an 8000 Hz sample rate would result in 240 digital speech samples. Other frame sizes and/or sampling rates could also be used.

L feature parameters for the speech data segment are computed in step 406 by "parameterizing" labeled data on a frame or subframe basis. The computed L-dimension feature vector corresponds to speech parameters which will provide optimal separation of the identified classes. In a preferred embodiment, these feature parameters include values computed for two "subframe" segments of the current frame. As discussed previously, these feature parameters can include: (1) left subframe correlation coefficient over expected pitch range, (2) left subframe LPC gain, (3) left subframe low-band to high-band energy ratio, (4) left subframe energy ratio of current segment against maximum energy off prior segments with the appropriate class, (5) right subframe correlation coefficient over expected pitch range, (6) right subframe LPC gain, (7) right subframe low-band to high-band energy ratio, (8) right subframe energy ratio of current segment against maximum energy of H prior segments with the appropriate class. More, fewer, or different features can be used in alternate embodiments. For example, features can also include spectra/coefficients, Cepstral coefficients, or first derivative slope change integration.

Steps 408–412 correspond to functions performed by generate M training vectors block 250 (FIG. 1). In step 408, computed feature parameters are assigned to the appropriate class. In step 410, a labeled feature vector is stored to a memory device.

In step 412, normalization is computed, as described previously, by computing the mean $\mu_i$, and standard deviation, $\sigma_i$, over the number of original training vectors M, where i ranges from 1 to L.

A determination is made in step 414 whether more labeled data segments are available. If so, steps 404–412 are repeated. If step 414 indicates that all feature vectors have been computed, step 416 stores the now complete normalization vectors to static memory.

Steps 418–426 correspond to the functions performed by MLP backpropagation block 260 (FIG. 1). In step 418, an MLP classifier architecture is selected. The MLP classifier is used for classification of the data and is randomly or deterministically initialized prior to computation of connection weights. FIGS. 2–10 illustrated several embodiments of MLP architectures.

One embodiment of the classifier architecture incorporates a two-layer, ten perceptron structure with eight inputs and two outputs corresponding to the current speech analysis segment, although other embodiments are also appropriate.

In step 420, stored vectors are used in a supervised learning mode to train the MLP network using a backpropagation adaptation process which computes the MLP classifier parameters. Input data vectors are first normalized in step 420 using the normalization vectors stored to memory in step 416. As discussed previously, the resulting vectors have zero mean and unit variance, assuming that the training data closely approximates the real-time feature statistics. In a preferred embodiment, a common steepest descent algorithm is used to adjust the weights during adaptation, or network training.

In step 422, classifier error is computed. Step 424 determines whether the classifier error is greater than an apriori determined value, epsilon. If so, the procedure branches to step 420 for another iteration. If the classifier error consistently is greater than epsilon, then the backpropagation algorithm is not converging to the desired accuracy of the result. In such a case, data can be relabeled or features in the feature set can be changed to improve the class discrimination.

Using this process, the weights are adjusted after the presentation of each individual feature vector. Over multiple iterations, this eventually results in the definition of a near-optimal, multidimensional "hyper-surface" which best separates the modal classes. As described previously, irrelevant or uncorrelated input vector features will have low-connection strength to the output neurons and will consequently have little effect on the final classification.

Neural networks are especially adept at determining relative importance among a large set of input feature components, whereby components that provide for class separability are given greater weight than those that do not. This inherent "feature ranking" characteristic of neural networks essentially eliminates the need for further statistical feature analysis and parameter ranking methods which are typically required for classical recognizer design.

Once training is complete, step 426 stores the W near-optimal connection weights in perceptron connection weight memory 270 (FIG. 1) of transmitter 20. The procedure then ends 428. The stored weights and normalization data will be accessed during real-time speech analysis by MLP classifier 70 (FIG. 1) as will be discussed in conjunction with FIGS. 13–14.

Figure 12:
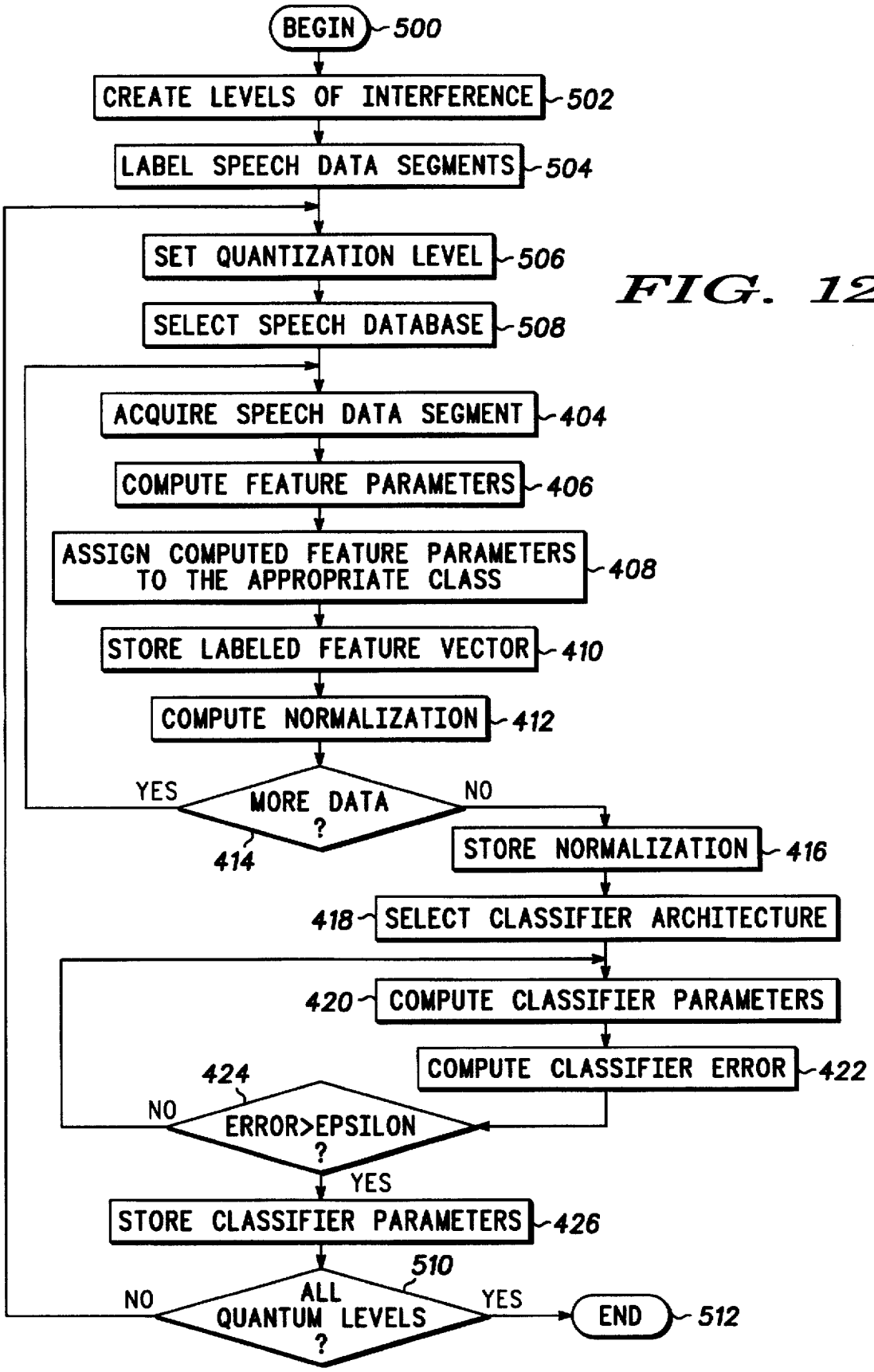
FIG. 12 illustrates an offline MLP adaptation process including Q quantum interference levels in accordance with an alternate embodiment of the present invention.

FIG. 12 illustrates an offline MLP adaptation process including Q quantum interference levels in accordance with an alternate embodiment of the present invention. The process illustrated in FIG. 12 corresponds to functions performed by offline adaptation processor 220 (FIG. 1). The process is similar to the process described in conjunction with FIG. 11, except that FIG. 12 further illustrates the perceptron connection weight and normalization factor training and development procedure for the given vocoder architecture.

The method begins 500 by performing a step 502 of creating Q levels of speech data, where multiple levels of interference are applied to the speech database in order to create Q speech databases from the original single database. In step 504, speech data segments are labeled with N identified classes for each desired quantum interference level. As described previously, for example, speech segments can be labeled as "periodic" or "non-periodic" classes in a two-class compression method. In alternate embodiments, more or different classes can be used, such as "degree-of-periodicity" classes or phonetic classes. Class labels may or may not change depending upon the level of interference. Labeled data is stored to memory for each quantum interference level.

Steps 506, 508, 404, and 402 represent steps performed by parameterized labeled data block 240 (FIG. 1). In step 506, the quantum level of interference is set for the current adaptation iteration. In step 508, a speech database associated with the quantum interference level is selected.

Steps 404–426 are performed similarly to steps 404–426 described in conjunction with FIG. 11. After steps 404–426, a determination is made in step 510 whether all quantum levels have been trained. If all quantum levels have not been trained, the procedure branches back to step 506, which sets the next level of interference. After all quantum levels have been trained and each set of weights and normalization factors have been stored to static memory, the procedure ends 512.

Figure 13:
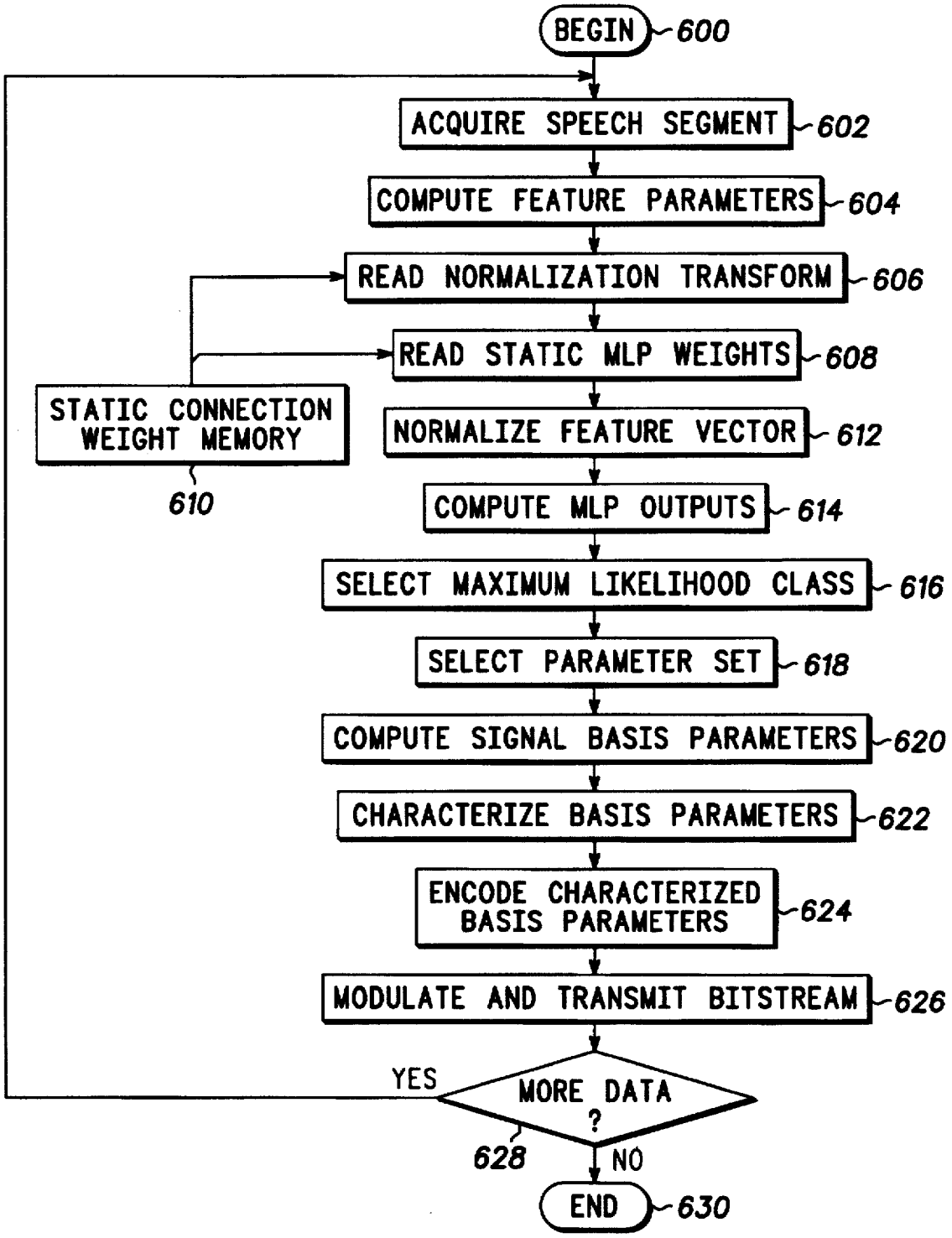
FIG. 13 illustrates a neural network controlled speech analysis process in accordance with one embodiment of the present invention.

FIG. 13 illustrates a neural network controlled speech analysis process in accordance with one embodiment of the present invention. The speech analysis process illustrated in FIG. 13 corresponds to functions performed by neural network controlled speech analysis processor 50 (FIG. 1). Steps 602–604 correspond to parameterize data block 60 (FIG. 1).

The method begins 600 by acquiring a speech segment in step 602. Step 602 loads a segment of pre-processed digital speech samples according to an apriori "frame" structure. As explained above, for example, a typical frame structure can be on the order or 30 ms, which is the equivalent of 240 samples at an 8000 Hz sample rate. Alternate embodiments can use other frame sizes.

In step 604, labeled data is "parameterized" on a frame or subframe basis, resulting in L computed feature parameters. The computed L-dimension feature vector corresponds to speech parameters which will provide optimal or near-optimal classifier separation of the identified classes. In a preferred embodiment which classifies speech as "periodic" or "non-periodic", these feature parameters include values computed for two "subframe" segments of the current frame. As explained previously, in a preferred embodiment, these feature parameters include: (1) left subframe correlation coefficient over expected pitch range, (2) left subframe LPC gain, (3) left subframe low-band to high-band energy ratio, (4) left subframe energy ratio of current segment against maximum energy of H prior segments with the appropriate class, (5) right subframe correlation coefficient over expected pitch range, (6) right subframe LPC gain, (7) right subframe low-band to high-band energy ratio, (8) right subframe energy ratio of current segment against maximum energy of H prior segments with the appropriate class. In alternate embodiments, more, fewer, or different features can also be useful, such as spectral coefficients, Cepstral coefficients, interference estimates, or first derivative slope change integration, for example.

Also as explained previously, in addition to the use of feature context via the implementation of two-frame subframe features, improved classification performance using the preferred features across speech and nonspeech segments is obtained by adding small levels of Gaussian noise to the analysis segment prior to feature calculation. This feature calculation step serves to bias the classifier against false classification in "near silence" conditions.

Steps 606–616 correspond to functions performed by MLP classifier block 70 (FIG. 1). After the computing L feature parameters, step 606 reads normalization transform by accessing static connection weight memory 610 (e.g., memory 270, FIG. 1) which was initialized by an offline adaptation process. In a preferred embodiment, the normalization transform consists of 2*L vectors which consist of mean and sigma of each feature parameter. In order to ensure that the weighted summations fall within the sigmoid transition region, data normalization can first be employed on the parameterized data set by subtracting the mean $\mu_i$ and dividing by $\sigma_i$, where i ranges from 1 to L, as computed over the number of original training vectors M. The resulting computed parameters will have zero mean and unit variance, assuming that the training data closely approximates the real-time feature statistics.

Similarly, in step 608, static MLP weights are read by accessing static connection weight memory 610. Step 608 also initializes the connection weights of the MLP classifier (e.g., MLP classifier 70, FIG. 1).

Following weight initialization, step 612 normalizes the feature vector by applying the normalization transform to the L-dimensional feature vector. In step 614, MLP outputs Class 1–Class N for the L-dimensional feature vector are computed. As described previously, in a preferred embodiment, the weighted sum of inputs plus a bias weight is computed for each perceptron, followed by an activation function, or sigmoid f(s), which is computed for each perceptron by: $1/(1+e^{-s})$. Following computation of the perceptron output for Class 1–Class N, step 616 selects the maximum-likelihood class.

Steps 618–622 correspond to MLP-controlled characterizing methodology block 80 (FIG. 1). The identified class from step 616 is passed to the select parameter set step 618, which chooses from P available parameter sets, depending upon the identified input class. These parameter sets comprise a list of "basis elements" which are used to represent the speech waveform in a data compression application. The parameter sets can be a single parameter set for all classes or multiple parameter sets, each of which comprises a family of classes which the chosen parameter set represents. For example, in an LPC-based approach, speech could be modeled using LPC coefficients and excitation waveform as the "basis elements" of the speech. The excitation waveform can subsequently be represented by several other basis element parameters including, for example, excitation basis element energy, excitation basis element mean, excitation basis element period, and related parameters which measure modeling error for each of the modeled basis elements.

In step 620, a number of speech basis parameters are computed which represent the speech waveform. After computation of the signal basis parameters, step 622 characterizes the basis parameters by exploiting the classification derived in select maximum likelihood class step 616 to optimally represent the characteristics of each of the basis parameters.

In one embodiment, the input waveform is classified into a category which reflects either speech or nonspeech data. This type of speech/nonspeech classification is sometimes referred to as voice activity detection, and is performed in an additional classifier stage embodied within the MLP classifier block 70 (FIG. 1).

In the case of a "non-speech" classification, the usual characterization and encoding process is not performed. This modal classification is of use when the architecture of FIG. 1 is part of a multi-channel communication system. In this situation, a non-speech classification results in the re-allocation of bandwidth resources to active channels, effectively increasing system capacity and efficiency. For this scenario, the receiver corresponding to the inactive channel can output a low level of noise, sometimes referred to as "comfort noise" over the duration of the non-speech mode.

In the case of a "speech" classification, the subsequent classification can indicate the degree of periodicity associated with the waveform segment under consideration. Typically, sampled speech waveforms can be classified as highly-correlated (periodic) speech, un-correlated (non-periodic) speech, or more commonly, a mixture of both. For the apparatus illustrated in FIG. 1, the modal estimate derived by the MLP classifier block 70 provides either a fractional value representing the degree of speech periodicity or a non-speech indication. In alternate embodiments, other modal classes can also be used, such as phonetic classifications, for example. Modal estimates enable the voice coder to adapt to the input waveform by selecting a modeling method and coding method which exploits the inherent characteristics of the given mode.

Step 622 includes functions controlled by the neural network process. In one embodiment, given a modal classification of speech derived by the neural network, the characterize basis parameters step 622 can divide its effort into two modeling methodologies which capture the basis elements of the periodic, correlated portion of the speech and the non-periodic, uncorrelated portion of the speech.

In one embodiment of this technique, the neural network classification would consist of either purely periodic or purely non-periodic designations. In this simple bi-modal situation, based upon the neural network classification, the characterizing methodology would select one of two modeling methods which attempt to capture the basis elements of each distinct mode for each basis parameter.

For the purely periodic case, specific portions of the speech or excitation waveform can be extracted for modeling in the time and/or frequency domain, assuming limited non-periodic contribution. Alternatively, for the purely non-periodic case, the speech or excitation waveform can be modeled assuming limited periodic contribution.

Data reduction is achieved by the application of signal processing steps specific to the classification mode. For example, one embodiment of the present invention represents the excitation waveform using several basis element parameters which include energy, mean, excitation period, and modeling error for each of the basis elements. Signal processing steps that characterize each of the basis elements and basis element modeling errors can vary depending upon the modal classification. Correlation techniques, for example, may prove to be useful only in the case of significant periodic energy. Spectral or Cepstral representations might only provide a benefit for specific periodic or phonetic classes.

Similarly, characterization filtering applied for the purposes of data reduction (e.g., lowpass, highpass, bandpass, pre-emphasis, or de-emphasis) may only be useful for particular modes of speech, and can, in fact, cause perceptual degradation if applied to other modes. Each basis parameter used to represent the compressed speech waveform can have multiple characterization methods. In a preferred embodiment, each characterization method is chosen with the specific class properties for that parameter in mind so as to achieve maximum data reduction while preserving the underlying properties of the speech basis elements.

Following characterization step 622, an appropriate encoding methodology for the selected mode is selected in step 624. In a preferred embodiment, each of the classes maps to an optimal or near-optimal encoding method for each characterized basis element. For example, periodic and non-periodic classifications could utilize separate VQ codebooks developed specifically for each mode for each of the characterized basis elements and characterized basis element modeling errors. Furthermore, specific codebook structures and codebook methods, such as VQ, staged VQ, or wavelet VQ may be more efficient for certain modal states. For example, wavelet VQ implementations would provide little coding gain for those modal states known to have a uniform, or "white" energy distribution across a wavelet decomposition.

In an alternate embodiment, an MLP-controlled pseudo-continuous methodology is used which adjusts bandwidth allocation based upon the periodic and non-periodic components present in the waveform under consideration. Some prior-art methods use a number of algorithmic techniques to separate the composite waveform into orthogonal waveforms, where each waveform can be characterized individually, transmitted, and used to reconstruct the speech waveform.

Step 624 corresponds to MLP-controlled encoding methodology block 90 (FIG. 1). In the context of the method and apparatus of the present invention, encode characterized basis parameters step 624 can control bandwidth allocation between the separated, orthogonal components by using the single or multi-stage, MLP-derived modal classification. In this manner, an MLP-derived degree of periodicity (DP), where $0.0<DP<1.0$, controls the bandwidth allocated toward modeling and characterization of the periodic portion and the non-periodic portion of each characterized basis element.

For example, a VQ scheme incorporated within the encoding methodology could utilize the quantized value of the MLP-derived DP to control the size of each basis parameter codebook and each basis parameter modeling error codebook to be searched for each modal component. In this manner, the dominant parameters of the modeled waveforms (as measured by the neural network classifier) are modeled more accurately than the less-dominant secondary components. As such, the MLP-derived fractional DP value could map to a manageable number of codebook size increments for each signal component.

The embodiment discussed above would be especially beneficial using multi-stage VQ, whereby bandwidth can be adjusted for a given basis parameter by including or excluding successive stages in the multi-stage structure. In this manner, dominant parameters, as determined by the MLP classifier, can be more accurately modeled via inclusion of subsequent available stages in the multi-stage quantizer. Conversely, less dominant parameters can use fewer of the available quantizer stages. Such an embodiment would also be ideal for use within a variable-rate speech coding application, whereby the MLP classifier output controls the bandwidth required by the speech coder.

In step 626, the encoded bitstream is modulated and transmitted. A determination is then made in step 628 whether more data is available for characterization, coding, and transmission. If more data is available, the procedure branches to step 602 as illustrated in FIG. 13 and the analysis process begins again. If more data is not available, the procedure ends 630.

Figure 14:
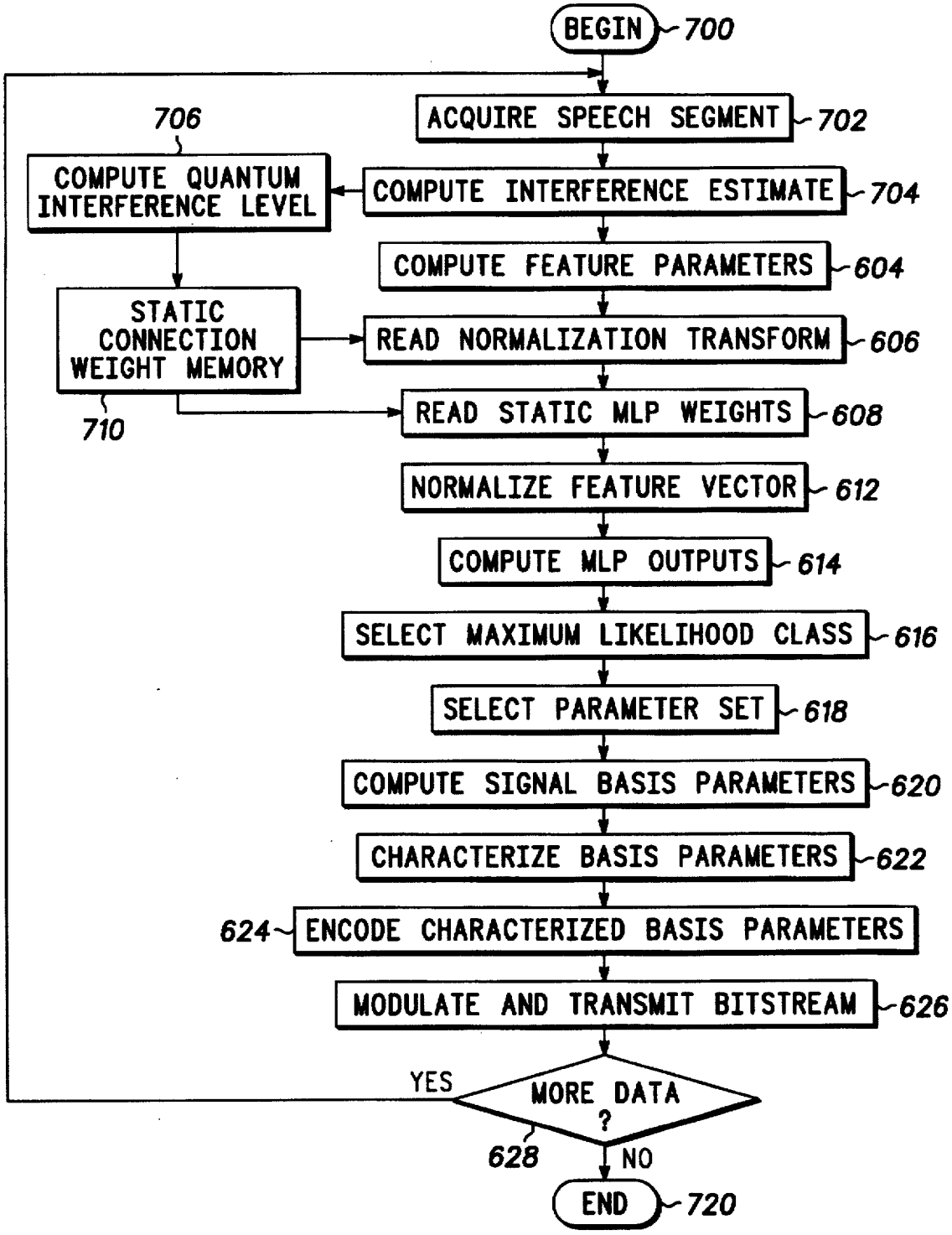
FIG. 14 illustrates a neural network controlled speech analysis process including Q quantum interference levels in accordance with a preferred embodiment of the present invention.

FIG. 14 illustrates a neural network controlled speech analysis process including Q quantum interference levels in accordance with a preferred embodiment of the present invention. The speech analysis process illustrated in FIG. 14 corresponds to functions performed by neural network controlled speech analysis processor 50 (FIG. 1). Steps 702–708 correspond to parameterize data block 60 (FIG. 1). Step 702 acquires a speech segment and essentially is the same as step 602 (FIG. 13).

In step 704, an interference estimate is computed for the current speech segment. In a preferred embodiment, the interference estimate can include entropy calculations or signal-to-noise (SNR) estimates, the calculation of such parameters being well known to those of skill in the art.

In step 706, the quantum interference level is computed by quantizing the interference estimate. The quantum level that best matches the interference estimate is passed to static connection weight memory 710 (e.g., memory 270, FIG. 1), which maps the quantized level into Q levels of connection weight memory and normalization factors. As explained previously, by training the network over a range of interference levels and by including an interference estimate as an input, the neural network can achieve higher correct classification rates in the face of interference.

Figure 15:
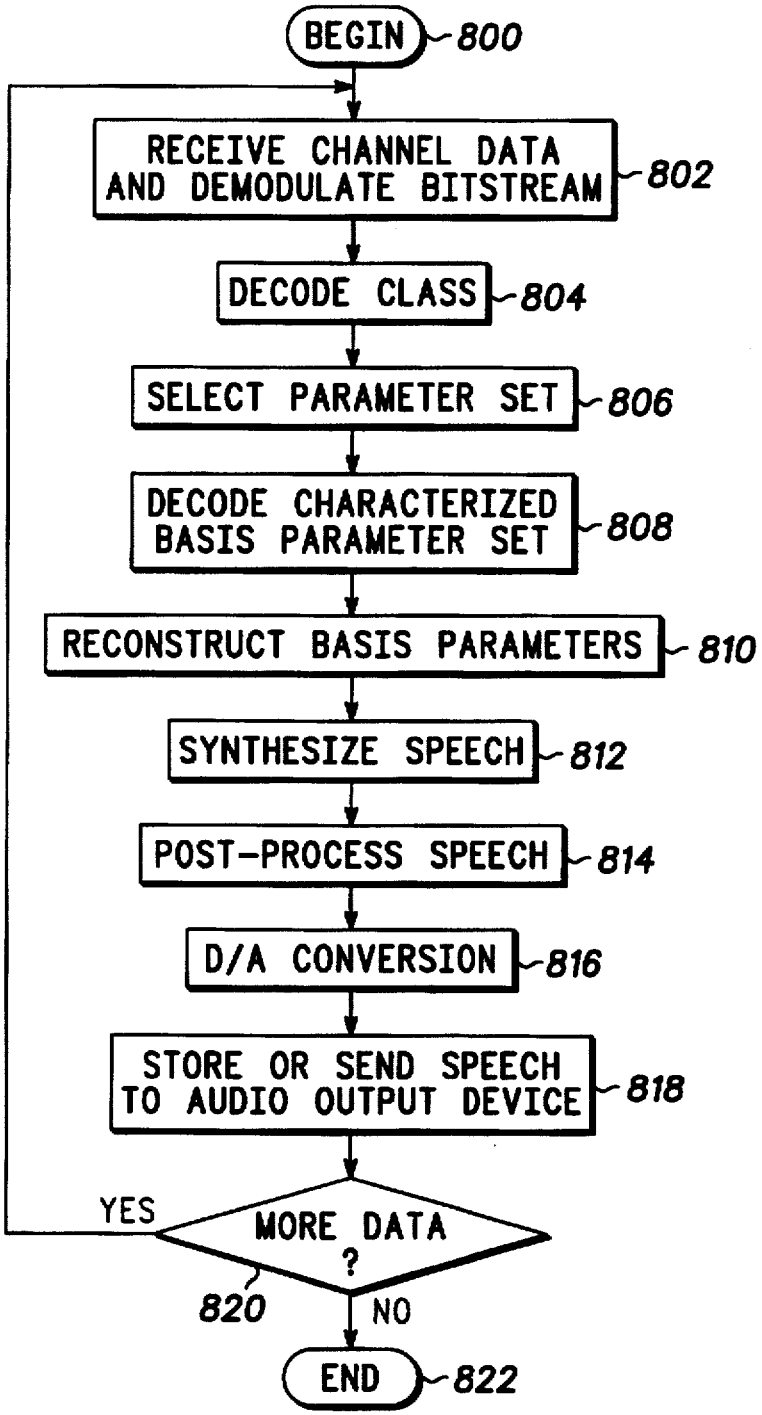
FIG. 15 illustrates a neural network controlled speech synthesis process in accordance with a preferred embodiment of the present invention.

Steps 604–628 are essentially similar to steps 604–628 described in conjunction with FIG. 13. After step 628, the procedure ends 720. FIG. 15 illustrates a neural network controlled speech synthesis process in accordance with a preferred embodiment of the present invention. The functions performed by the method illustrated in FIG. 15 correspond to neural network controlled speech synthesis processor 130 (FIG. 1). The method begins 800 when channel data from a transmission channel (e.g., channel 110, FIG. 1) is received and demodulated in step 802 using methods well known to those of skill in the art.

Steps 804–808 correspond to functions performed by MLP-controlled decoding methodology block 150 (FIG. 1). In step 804, the bits which correspond to the modal class determined by MLP classifier 70 (FIG. 1) are decoded. Step 806 then uses the decoded modal class to select a parameter set from P available parameter sets, depending upon the identified input class. These parameter sets comprise the list of "basis elements" which are used to represent the speech waveform within a data compression application.

The parameter sets can be a single parameter set for all classes or multiple parameter sets, each of which comprises a family of classes which the chosen parameter set represents. For example, speech can be modeled using LPC coefficients and LPC-derived excitation waveform as the "basis elements" of the speech. The excitation waveform can subsequently be represented by several other basis element parameters which can include, for example, excitation basis element energy, excitation basis element mean, excitation basis element period, and related parameters which measure modeling error for each of the modeled basis elements.

In step 808, the parameter set from step 806, the decoded class, and the demodulated bitstream are used to decode the characterized basis parameter set, thus reconstructing each of the characterized basis parameters. Step 808 uses decoding methods and codebooks which are the companion methods and codebooks to the MLP-controlled encoding methodologies used in the encode characterized basis parameters steps 624 (FIGS. 13 and 14).

Step 810 corresponds to functions performed by MLP-controlled reconstruction methodology block 160 (FIG. 1). In step 810, the basis parameters are reconstructed from the characterized basis parameter set. Step 810 implements a reconstruction method, optimized to the underlying data class, for each characterized parameter.

Step 812 corresponds to the functions performed by speech synthesizer 170 (FIG. 1). In step 812, the reconstructed basis parameters are used to synthesize the speech waveform. In one embodiment, the reconstructed excitation waveform is used to drive a direct form or lattice synthesis filter defined by the LPC prediction or reflection coefficients.

Step 814 corresponds to functions performed by post processor 180 (FIG. 1). The synthesized speech waveform is post processed in step 814, which performs functions such as de-emphasis and adaptive post-filter operations well known to those skilled in the art. Following post processing, the digital speech samples can be stored to a data storage medium (not shown), transmitted to a digital audio output device (not shown) or can be processed by D/A conversion step 816. Step 816 corresponds to functions performed by D/A converter 190 (FIG. 1).

After D/A conversion, the speech waveform can be stored or sent to an audio output device in step 818. A determination is then made in step 820 whether more data is available to be processed. If more data is available, the procedure branches back to step 802 as shown in FIG. 15. If no more data is available, the procedure ends 822.

In summary, the method and apparatus of the present invention provides a low-rate voice coder which uses advanced, vocoder-embedded neural network techniques. Improved performance over prior-art methods is obtained by employing neural network management of speech characterization, encoding, decoding, and reconstruction methodologies. The method and apparatus of the present invention implements advanced MLP-based structures in single or multi-stage arrangements within a low-rate, voice coding architecture to provide for improved speech synthesis, classification, robustness in interference conditions, bandwidth utilization, and greater flexibility over prior-art techniques.

What is claimed is:

1. A speech coding apparatus for encoding speech data which is input to the speech coding apparatus, the speech coding apparatus comprising:

an input device for receiving the speech data; and at least one processor coupled to the input device, the at least one processor for parameterizing the speech data to produce at least one feature vector which describe parameters of the speech data, applying a first neural network to the at least one feature vector to obtain at least one speech classification of the speech data, creating characterized speech data by characterizing the speech data using a characterization methodology which depends on the at least one speech classification, and creating an encoded bitstream by encoding the characterized speech data.

2. The speech coding apparatus as claimed in claim 1 further comprising:

a memory device coupled to the at least one processor, the memory device for storing connection weight information used by the first neural network, wherein the connection weight information was predetermined by an adaptation process which stored the connection weight information in the memory device, wherein the at least one processor, during the step of applying the first neural network to the at least one feature vector, is also for reading the connection weight information from the memory device and using the connection weight information in conjunction with the first neural network when the first neural network is applied to the at least one feature vector.

3. The speech coding apparatus as claimed in claim 2, wherein the at least one processor is also for determining an interference estimate which estimates a level of interference co-existent with the speech data, and for inputting the interference estimate into the first neural network when the first neural network is applied to the at least one feature vector.

4. The speech coding apparatus as claimed in claim 2, wherein the at least one processor is also for determining an interference estimate which estimates a level of interference co-existent with the speech data, wherein the connection weight information comprises multiple sets of weights, each set of weights corresponding to an interference level, the at least one processor also for selecting the set of weights from the multiple sets of weights based on the interference estimate, and for using the set of weights as the connection weight information.

5. The speech coding apparatus as claimed in claim 2, wherein the at least one processor is further for using at least one previous speech classification which was determined by the first neural network as an input to the first neural network when the first neural network is being applied to the at least one feature vector.

6. The speech coding apparatus as claimed in claim 5, wherein the at least one processor is also for determining an interference estimate which estimates a level of interference co-existent with the speech data, and for inputting the interference estimate into the first neural network when the first neural network is applied to the at least one feature vector.

7. The speech coding apparatus as claimed in claim 5, wherein the at least one processor is also for determining an interference estimate which estimates a level of interference co-existent with the speech data, wherein the connection weight information comprises multiple sets of weights, each set of weights corresponding to an interference level, the at least one processor also for selecting the set of weights from the multiple sets of weights based on the interference estimate, and for using the set of weights as the connection weight information.

8. The speech coding apparatus as claimed in claim 2, wherein the memory device is also for storing second connection weight information used by a second neural network, and the at least one processor is also for applying the second neural network to the at least one speech classification which is output from the first neural network, wherein the second neural network uses the second connection weight information in conjunction with the second neural network and uses the at least one speech classification as an input to determine a more accurate speech classification, wherein the characterization methodology depends on the more accurate speech classification.

9. The speech coding apparatus as claimed in claim 8, wherein the at least one processor is also for determining an interference estimate which estimates a level of interference co-existent with the speech data, and for inputting the interference estimate into the first neural network when the first neural network is applied to the at least one feature vector.

10. The speech coding apparatus as claimed in claim 9, wherein the at least one processor is also for inputting the interference estimate into the second neural network when the second neural network is applied to the at least one speech classification which is output from the first neural network.

11. The speech coding apparatus as claimed in claim 8, wherein the at least one processor is also for determining an interference estimate which estimates a level of interference co-existent with the speech data, wherein the connection weight information comprises multiple sets of weights, each set of weights corresponding to an interference level, the at least one processor also for selecting the set of weights from the multiple sets of weights based on the interference estimate, and for using the set of weights as the connection weight information for the first neural network.

12. The speech coding apparatus as claimed in claim 11, wherein the at least one processor is also for selecting a second set of weights from the multiple sets of weights based on the interference estimate, and for using the second set of weights as the connection weight information for the second neural network.

13. The speech coding apparatus as claimed in claim 1, further comprising:

a transmission channel interface coupled to the processor, wherein the transmission channel interface is for sending the encoded bitstream to a speech decoding apparatus which performs inverse processes to those performed by the speech coding apparatus so that synthesized speech data which approximates the speech data can be obtained.

14. The speech coding apparatus as claimed in claim 1, wherein the at least one processor is also for applying the first neural network to the at least one feature vector to obtain the at least one speech classification of the speech data, wherein the at least one speech classification comprises at least two degrees of periodicity of the speech data.

15. The speech coding apparatus as claimed in claim 1, wherein the at least one processor is also for applying the first neural network to the at least one feature vector to obtain the at least one speech classification of the speech data, wherein the at least one speech classification comprises multiple phonemes which approximate the speech data.

16. The speech coding apparatus as claimed in claim 1, wherein the at least one processor is also for parameterizing the speech data to produce the at least one feature vector, wherein the at least one feature vector comprises a subframe correlation coefficient over expected pitch range, a subframe LPC gain, a subframe low-band to high-band energy ratio, and a subframe energy ratio of a segment of the speech data against a maximum energy of multiple prior segments of the speech data.

17. The speech coding apparatus as claimed in claim 1, wherein the at least one processor, during the step of encoding the characterized speech data, is also for using an encoding methodology which depends on the at least one speech classification.

18. A speech decoding apparatus for decoding an encoded bitstream to produce synthesized speech data, the speech decoding apparatus comprising:

a transmission channel interface for receiving the encoded bitstream from a speech encoding apparatus; and at least one processor coupled to the transmission channel interface, the at least one processor for decoding a speech classification from a first portion of the encoded bitstream, wherein the speech classification was derived by a neural network in the speech encoding apparatus, the at least one processor also for decoding a remainder of the encoded bitstream using a decoding methodology which depends on the speech classification, resulting in a decoded bitstream, the at least one processor also for creating reconstructed speech basis elements from the decoded bitstream and producing the synthesized speech data using the reconstructed speech basis elements.

19. The speech decoding apparatus as claimed in claim 18, wherein the at least one processor, during the step of creating the reconstructed speech basis elements, is also for using a reconstruction methodology which is an inverse process to a characterization methodology used by the speech encoding apparatus, the characterization methodology having been determined from the speech classification.

20. A method for encoding speech data by a speech coding apparatus comprising the steps of:

a) acquiring a segment of the speech data;

b) parameterizing the segment of the speech data to produce at least one feature vector which describes parameters of the speech data;

c) applying a first neural network to the at least one feature vector to obtain at least one speech classification of the speech data;

d) creating characterized speech data by characterizing the speech data using a characterization methodology which depends on the at least one speech classification; and e) creating an encoded bitstream by encoding the characterized speech data.

21. The method as claimed in claim 20 further comprising the steps of:

f) storing connection weight information used by the first neural network, wherein the connection weight information was predetermined by an adaptation process;

wherein step c) comprises the steps of:

c1) reading the connection weight information; and c2) using the connection weight information in conjunction with the first neural network when the first neural network is applied to the at least one feature vector.

22. The method as claimed in claim 21, wherein the at least one processor is also for g) determining an interference estimate which estimates a level of interference co-existent with the speech data, wherein the connection weight information comprises multiple sets of weights, each set of weights corresponding to an interference level;

wherein step c) further comprises the steps of:

c3) selecting the set of weights from the multiple sets of weights based on the interference estimate; and c4) using the set of weights as the connection weight information.

23. The method as claimed in claim 21, wherein step c) further comprises the step of:

c3) using at least one previous speech classification which was determined by the first neural network as an input to the first neural network when the first neural network is being applied to the at least one feature vector.

24. The method as claimed in claim 23, further comprising the step of:

g) determining an interference estimate which estimates a level of interference co-existent with the speech data; and wherein step c) further comprises the step of:

c4) inputting the interference estimate into the first neural network when the first neural network is applied to the at least one feature vector.

25. The method as claimed in claim 23, further comprising the step of:

g) determining an interference estimate which estimates a level of interference co-existent with the speech data, wherein the connection weight information comprises multiple sets of weights, each set of weights corresponding to an interference level;

wherein step c) further comprises the steps of:

c4) selecting the set of weights from the multiple sets of weights based on the interference estimate; and c5) using the set of weights as the connection weight information.

26. The method as claimed in claim 21, further comprising the steps of:

g) storing the connection weight information to be used by a second neural network;

h) applying the second neural network to the at least one speech classification which is output from the first neural network;

i) using the connection weight information in conjunction with the second neural network when the second neural network is applied to the at least one speech classification; and j) using the at least one speech classification as an input to the second neural network to determine a more accurate speech classification, wherein the characterization methodology and the encoding methodology depend on the more accurate speech classification.

27. The method as claimed in claim 26, further comprising the step of:

k) determining an interference estimate which estimates a level of interference co-existent with the speech data; and wherein step c) comprises the step of:

c3) inputting the interference estimate into the first neural network when the first neural network is applied to the at least one feature vector.

28. The method as claimed in claim 27, wherein step j) comprises the step of:

j1) inputting the interference estimate into the second neural network when the second neural network is applied to the at least one speech classification which is output from the first neural network.

29. The method as claimed in claim 26, further comprising the step of:

k) determining an interference estimate which estimates a level of interference co-existent with the speech data, wherein the connection weight information comprises multiple sets of weights, each set of weights corresponding to an interference level;

wherein the step c) further comprises the steps of:

c4) selecting the set of weights from the multiple sets of weights based on the interference estimate; and c5) using the set of weights as the connection weight information for the first neural network.

30. The method as claimed in claim 29, further comprising the step of:

l) selecting a second set of weights from the multiple sets of weights based on the interference estimate; and wherein step j) comprises the step of:

j1) using the second set of weights as the connection weight information for the second neural network.

31. The method as claimed in claim 21, further comprising the step of:

g) determining an interference estimate which estimates a level of interference co-existent with the speech data; and wherein step c) further comprises the step of:

c3) inputting the interference estimate into the first neural network when the first neural network is applied to the at least one feature vector.

32. The method as claimed in claim 20, further comprising the step of:

f) sending the encoded bitstream to a speech decoding apparatus which performs inverse processes to those performed by the speech coding apparatus so that synthesized speech data which approximates the speech data can be obtained.

33. The method as claimed in claim 20, wherein step c) comprises the step of:

c1) applying the first neural network to the at least one feature vector to obtain the at least one speech classification of the speech data, wherein the at least one speech classification comprises at least two degrees of periodicity of the speech data.

34. The method as claimed in claim 20, wherein step c) comprises the step of:

e1) applying the first neural network to the at least one feature vector to obtain the at least one speech classification of the speech data, wherein the at least one speech classification comprises multiple phonemes which approximate the speech data.

35. The method as claimed in claim 20, wherein step b) comprises the step of:

b1) parameterizing the speech data to produce the at least one feature vector, wherein the at least one feature vector comprises a subframe correlation coefficient over expected pitch range, a subframe LPC gain, a subframe low-band to high-band energy ratio, and a subframe energy ratio of the segment against a maximum energy of multiple prior segments.

36. The method as claimed in claim 20, wherein step e) comprises the step of:

e1) encoding the characterized speech data using an encoding methodology which depends on the at least one speech classification.

37. The method as claimed in claim 20, wherein the characterized speech data includes at least one parameter that represents the speech data, and step e) comprises the steps of:

e1) determining whether the at least one speech classification indicates that a particular parameter of the at least one parameter is a dominant parameter of the speech data;

e2) when the at least one speech classification indicates that the particular parameter is the dominant parameter of the speech data, encoding the particular parameter using a first quantization codebook having a first number of codebook entries; and e3) when the at least one speech classification indicates that the particular parameter is a less dominant parameter of the speech data, encoding the particular parameter using a second quantization codebook having a second number of the codebook entries, wherein the second number is smaller than the first number.

38. The method as claimed in claim 20, wherein the characterized speech data includes at least one parameter that represents the speech data, multiple quantizer stages are available to encode each of the at least one parameter, and step e) comprises the steps of:

e1) determining whether the at least one speech classification indicates that a particular parameter of the at least one parameter is a dominant parameter of the speech data;

e2) when the at least one speech classification indicates that the particular parameter is the dominant parameter of the speech data, encoding the particular parameter using a first number of quantization stages; and e3) when the at least one speech classification indicates that the particular parameter is a less dominant parameter of the speech data, encoding the particular parameter using a second number of quantization stages, wherein the second number is smaller than the first number.

39. The method as claimed in claim 20, further comprising the step, performed before step b) of:

f) adding a small level of Gaussian noise to the segment of the speech data.

40. A method for decoding an encoded bitstream to produce synthesized speech data, the method comprising the steps of:

a) receiving the encoded bitstream from a speech encoding apparatus;

b) decoding a speech classification from a fit portion of the encoded bitstream, wherein the speech classification was derived by a neural network in the speech encoding apparatus;

c) decoding a remainder of the encoded bitstream using a decoding methodology which depends on the speech classification, resulting in a decoded bitstream;

d) creating reconstructed speech basis elements from the decoded bitstream; and e) producing the synthesized speech data using the reconstructed speech basis elements.

41. The method as claimed in claim 40, wherein step d) comprises the step of:

d1) using a reconstruction methodology which is an inverse process to a characterization methodology used by the speech encoding apparatus, the characterization methodology having been determined from the speech classification.

* * * * *